US006138868A

United States Patent [19]

Yuyama et al.

[11] Patent Number: 6,138,868

[45] Date of Patent: Oct. 31, 2000

[54] AMPULE FEEDER

[75] Inventors: Shoji Yuyama; Naoki Koike; Yasuhiro Shigeyama, all of Toyonaka, Japan

[73] Assignee: Kabushiki Kaisha Yuyama Seisakusho, Osaka, Japan

[21] Appl. No.: 09/094,981

[22] Filed: Jun. 15, 1998

[30] Foreign Application Priority Data

| | | | |
|---|---|---|---|
| Mar. 25, 1997 | [JP] | Japan | 9-71553 |
| Mar. 25, 1997 | [JP] | Japan | 9-113308 |
| Jul. 31, 1997 | [JP] | Japan | 9-206598 |

[51] Int. Cl.[7] ..... G07F 11/00

[52] U.S. Cl. ..... 221/312 R; 221/242; 221/258; 221/311; 221/16; 221/268; 221/156

[58] Field of Search ..... 221/242, 258, 221/16, 268, 311, 312 R

[56] References Cited

U.S. PATENT DOCUMENTS

| | | | |
|---|---|---|---|
| 2,752,028 | 6/1956 | Mosokowitz et al. | 198/33 |
| 3,703,232 | 11/1972 | Zbiegien | 198/33 |
| 4,271,954 | 6/1981 | Gosney | 198/399 |
| 4,355,495 | 10/1982 | Lewis et al. | 53/579 |
| 4,526,292 | 7/1985 | Waxman | 221/97 |
| 4,860,922 | 8/1989 | Malservvisi et al. | 221/6 |
| 4,936,736 | 6/1990 | Meier | 414/746.1 |
| 5,061,443 | 10/1991 | Iijima et al. | 422/21 |
| 5,132,504 | 7/1992 | Iijima | 219/10.55 |
| 5,263,596 | 11/1993 | Williams | 221/53 |
| 5,704,516 | 1/1998 | Yuyami | 221/164 |
| 5,899,357 | 5/1999 | Yuyami et al. | 221/171 |

*Primary Examiner*—Christopher P. Ellis
*Assistant Examiner*—Michael E Butler
*Attorney, Agent, or Firm*—Wenderoth, Lind & Ponack, L.L.P.

[57] ABSTRACT

An ampule feeder which can discharge ampules one by one with high efficiency without the possibility of clogging. It includes an ampule container having a bottom plate pivotable in one direction. Ampules stored randomly in the container are moved onto an inclined top surface of an ampule receiver and raised. When the ampule receiver rises to its highest level, the ampules slide on its surface and drop onto a conveyor belt of a dispenser provided outside of the side wall of the ampule container. Ampules are thus discharged by the dispenser.

30 Claims, 33 Drawing Sheets

AMPULE FEEDER

BACKGROUND OF THE INVENTION

This invention relates to an ampule feeder for feeding according to prescriptions ampules and vials containing injection medication and housed randomly in a container.

Unexamined Japanese patent publications 7-300237, 8-230826 and 8-225140 disclose ampule feeders for feeding ampules housed randomly in a container.

The ampule feeder disclosed in the first publication has a head disposed under the container bottom and having a recessed top formed with a groove. The head is pushed up by a cylinder head to lift an ampule on the top of the head. The ampule thus lifted is sucked by a sucker and moved onto a conveyor.

The ampule feeder of the second publication has an ampule container with two cells partitioned by a movable partitioning plate so that the volumes of the cells are variable. A pusher rod with an ampule-receiving head is provided in each cell. The head has an inclined top surface. When each rod is pushed up to a predetermined height with an ampule on the inclined top surface of the head, the top inclined surface of the head aligns with a conveyor line, so that the ampule slides down into the conveyor line.

The ampule feeder of the third publication has an ampule feeder with an inclined bottom. A pusher having a inclined top is vertically movably inserted through a hole formed in the bottom of the container. When the pusher is pushed up to a predetermined height with an ampule on the inclined top, the inclined top aligns with an inclined platform, so that the ampule slides down onto the platform. The ampule on the platform is now pushed up by another pusher and discharged. Ampules can thus be discharged one by one without the possibility of being broken.

Ampule feeders of this type have an advantage in that there is no need to arrange ampules in containers in an orderly manner. Thus, many of today's ampule feeders are of this type.

But this type of ampule feeders have their own problems. One problem is that the pusher means is frequently pushed up with no ampule on the head. This happens because ampules put in the container in an disorderly manner tend to get stuck and deadlocked especially near the pusher.

An object of this invention is to provide an ampule feeder which is simple in structure and which can discharge ampules one by one with high efficiency without the possibility of clogging.

SUMMARY OF THE INVENTION

According to this invention, there is provided an ampule feeder comprising an ampule container having a bottom plate inclinable in one direction about an axis extending along one edge of the bottom plate. The ample container is capable of randomly accommodating a plurality of ampules, and an ampule receiver is vertically movable along a side wall provided at the one edge of the bottom plate. The ampule receiver has a top surface substantially as wide as the ampule diameter for receiving a plurality of ampules and arranging them in order. Also, a dispenser means is provided for discharging the ampules on the top surface of the ampule receiver in a direction in which the ampules on the top surface are arranged.

With this arrangement, the ampules housed in a random manner are discharged reliably one by one.

Since the bottom plate of the container is inclined in one direction, ampules in the container will roll down onto the ampule receiver by gravity. When the ampule receiver is raised with the ampules on its top surface having a width substantially equal to the ampule diameter, any ampules on the receiver protruding from the top surface will drop. Thus, the ampules remaining on the ampule receiver are arranged in order.

Thus, the ampules raised by the ampule receiver are discharged one by one from the discharge port by the dispenser. The dispenser may include means for discharging ampules arranged in a row on the ampule receiver in the direction of the row or means for moving the ampules to the outside of the side wall of the ampule container and then discharging the ampules in parallel to the direction in which they are arranged.

The ampule container may be detachably mounted to the feeder. The detachable container is provided with shutters so that ampules may spill from the container when the container is detached. The shutters are opened and closed by a shutter drive means. A shelf is provided adjacent the ampule receiver. When the container is mounted on the shelf, the shutter drive means is rotated to open the shutters.

The bottom plate of the ampule container may be designed to be inclinable in one direction. In this case, the inclination angle of the bottom plate is adjusted by an inclination adjuster. The inclination angle may be changed continuously or in a stepwise manner.

A discharge means can be connected to the rear of the dispenser. The discharge means stores a predetermined number of ampules during the standby phase so that a necessary number of ampules can be discharged quickly on command. The discharge means is e.g. a rotor formed with a plurality of ampule-receiving grooves and arranged such that a groove at the ampule-receiving position extends in the dispensing direction of the dispenser. With this arrangement, it is possible to supply necessary ampules smoothly, quickly and reliably.

Other features and objects of the present invention will become apparent from the following description made with reference to the accompanying drawings, in which:

DETAILED DESCRIPTION OF THE PREFERRED EMBODIMENT (First Embodiment)

Figure 1:
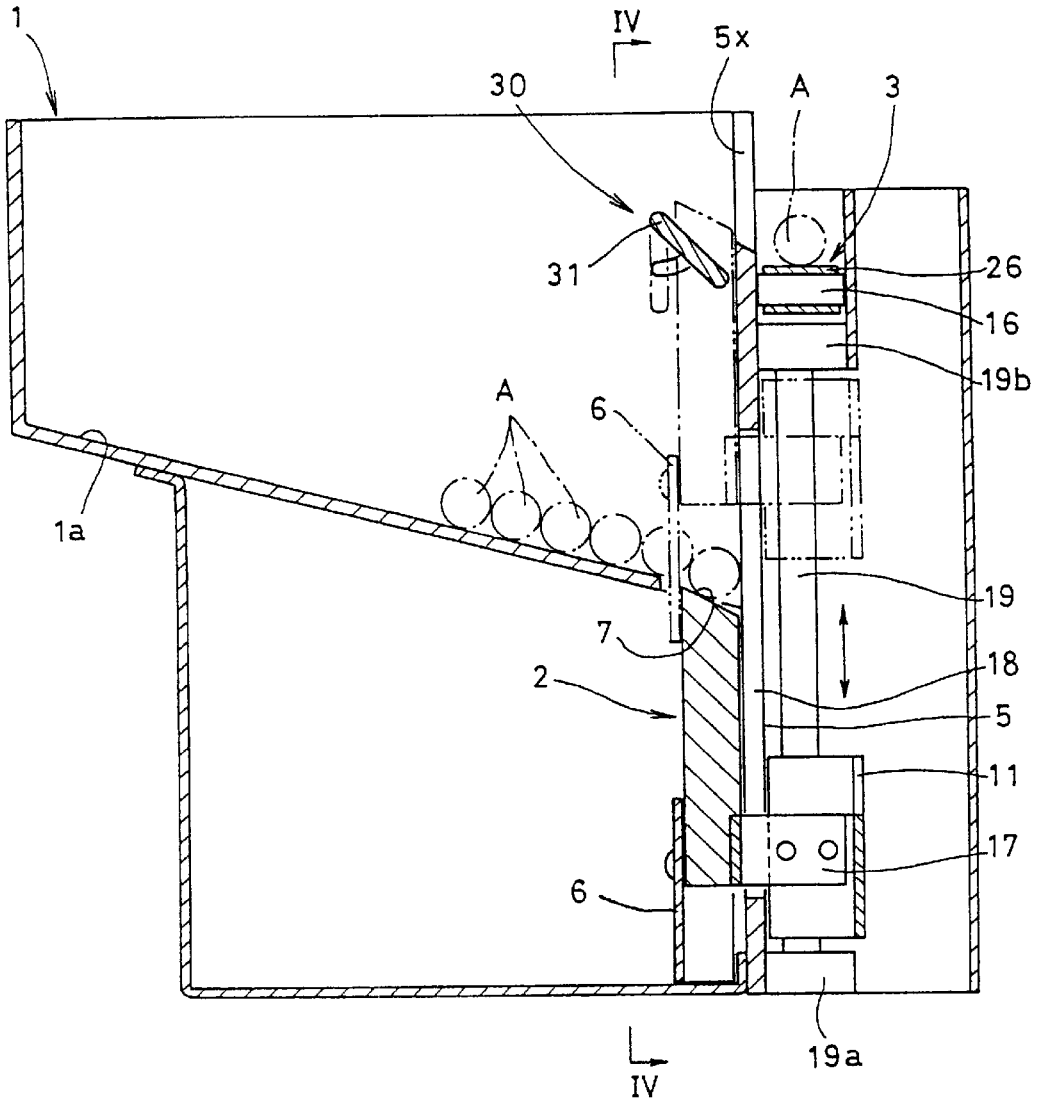
FIG. 1 is a partial sectional view of an ampule feeder of a first embodiment.
Figure 2:
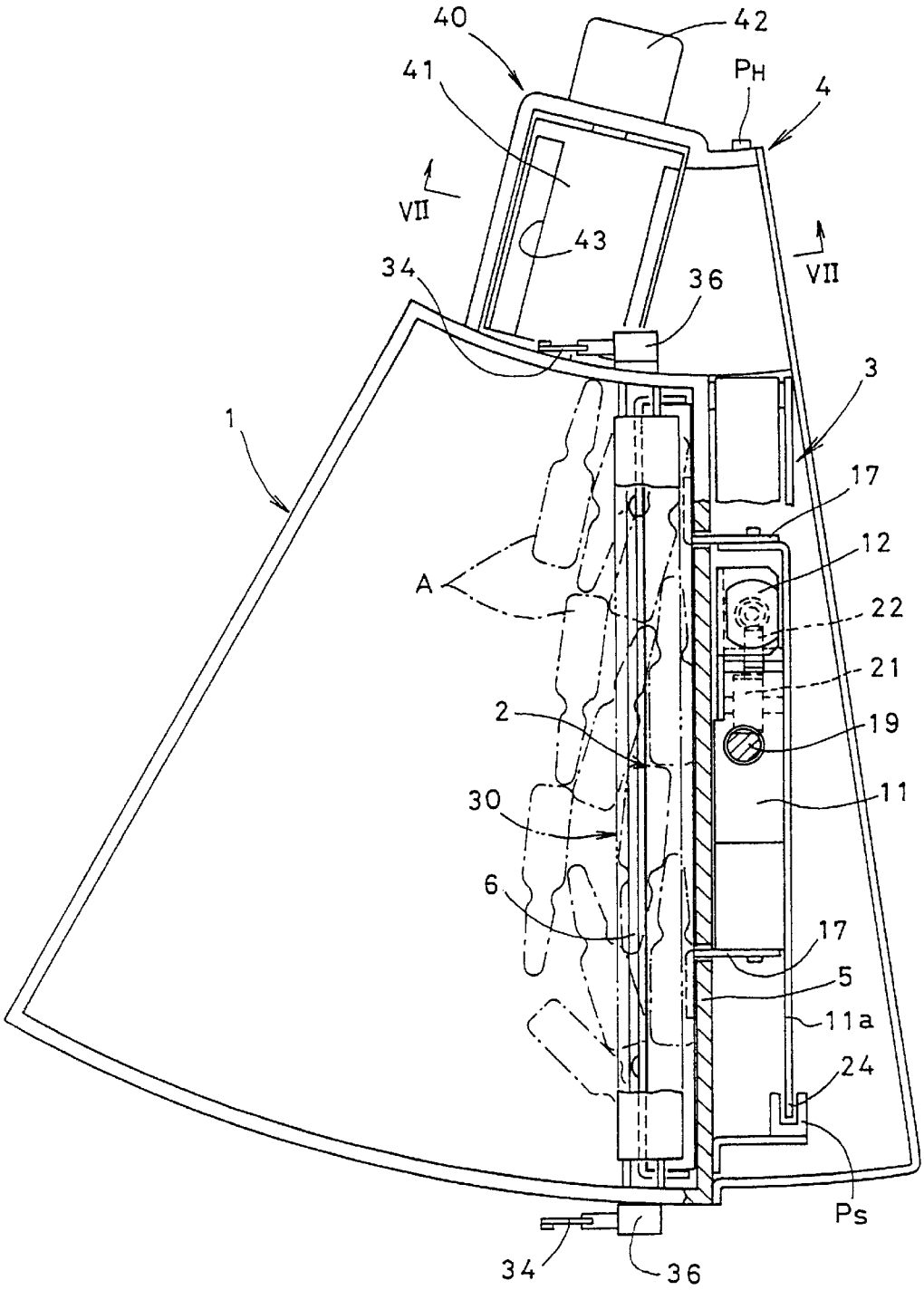
FIG. 2 is a plan view of the ampule feeder of FIG. 1.
Figure 3:
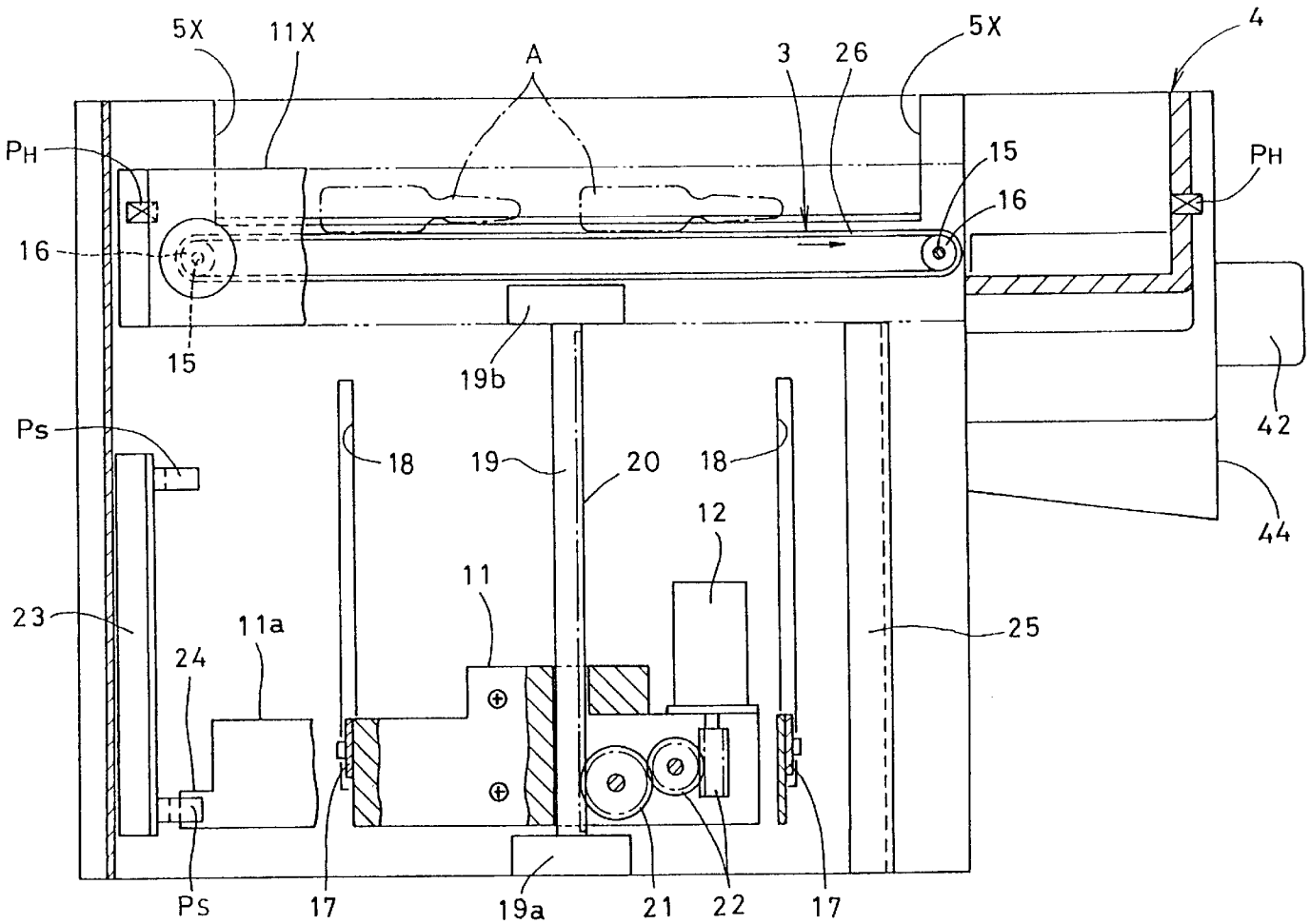
FIG. 3 is a side view of the ampule feeder of FIG. 1.

An embodiment of this invention is described with reference to the drawings. Referring to FIGS. 1–3, the ampule feeder of this embodiment comprises an ampule container 1, an ampule receiver 2 provided on one side of the container 1, and an ampule dispenser or transport means 3 provided on the top of the ampule receiver 2. As shown in FIG. 2, an ampule catcher 4 is provided outside the discharge port of the container 1. An ampule discharge means 40 with a rotor 41 is provided by the side of the ampule catcher 4.

The ampule container 1 holds many ampules A in a random manner and has a bottom plate 1*a* inclined in one direction. The ampule receiver 2 is vertically slidable along a side wall 5, guided by the inner surface of the side wall 5. A shutter 6 has an upper end fixed to the lower end of the ampule receiver 2.

The shutter 6 prevents ampules A from dropping into the space under the ampule receiver 2 when it is raised.

The ampule receiver 2 is of substantially the same length as the side wall 5 and is at least 1.5 times longer than the ampules. Its top surface is inclined downwardly toward the side wall. Its thickness is substantially the same as the diameter of an ampule. Reference numeral 5*x* indicates a cutout in the side plate through which ampules are pushed out.

The ampule receiver 2 is moved up and down by a drive unit provided outside the side wall 5. As shown in FIG. 3, the drive unit includes a support plate 11 moved up and down by a motor 12. The plate 11 carries a motor (not shown) for the dispenser 3 and has an overhang 11*a* which supports a pulley 16 driven by a pulley shaft 15 coupled to the output shaft of the motor. A pair of arms 17 are mounted to both ends of the support plate 11. The arms 17 extend through vertical guide grooves 18 formed in the side wall 5 and are coupled to the ampule receiver 2.

A vertical rod 19 slidably extends through the support plate 11 at its center. It has on one side thereof a rack 20 in engagement with a speed reducer comprising a pinion 21 and gears 22. The support plate 11 is moved up and down by a motor 12 through the speed reducer. The rod 19 has its top and bottom ends supported by support members 19*a* and 19*b*.

Two sensors PS are mounted on a sensor mounting plate 23 at its top and bottom (FIG. 3). When a detection plate 24 provided at the end of the overhang 11*a* passes by either sensor PS, light is interrupted, so that the top or bottom sensor PS detects that the ampule receiver 2 is at the highest or lowest level. The receiver 2 is thus stopped at the highest and lowest positions. Numeral 25 denotes a mounting plate.

Figure 4:
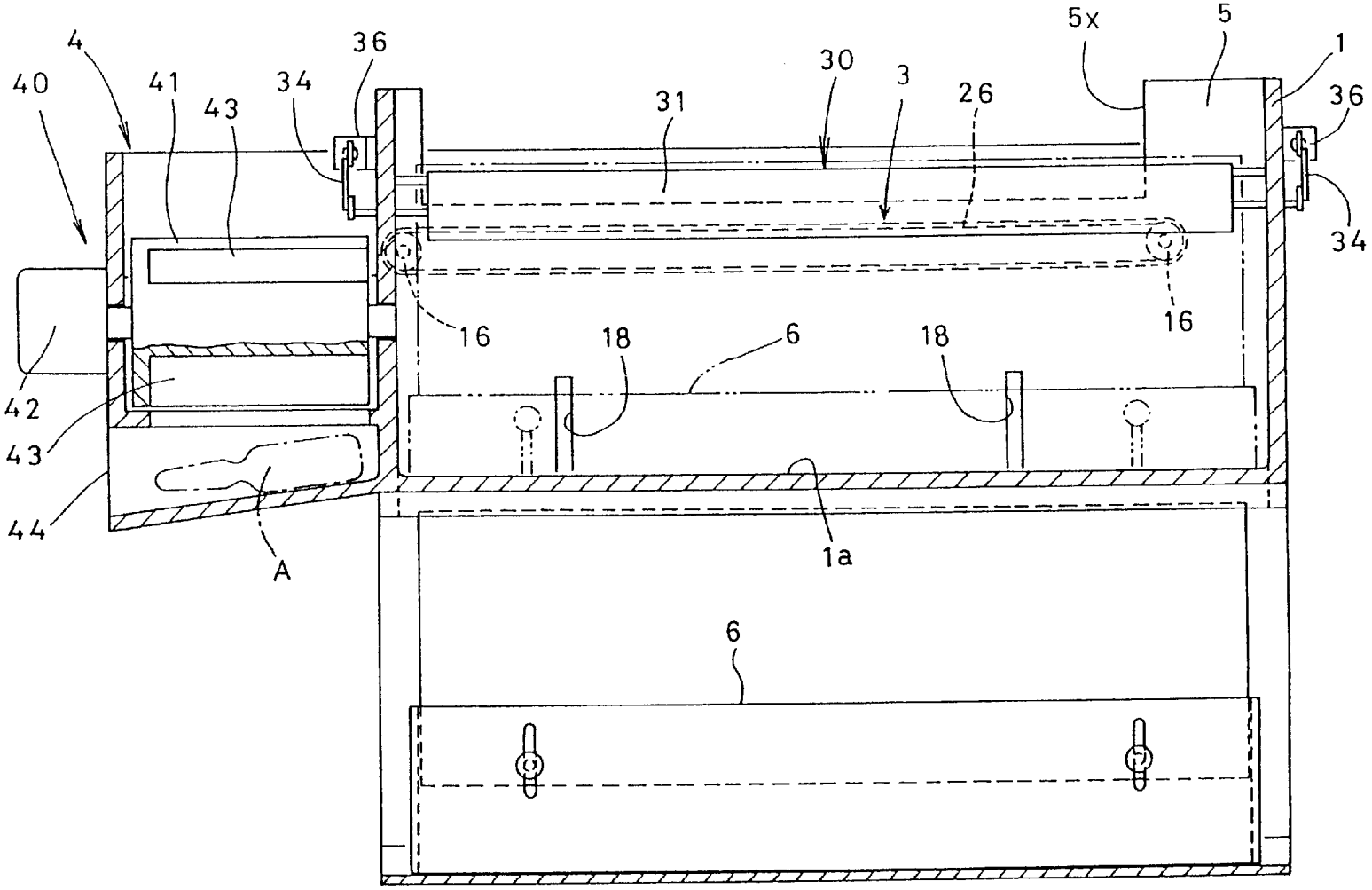
FIG. 4 is a sectional view taken along line IV—IV of FIG. 1.

FIG. 4 is a sectional side view taken along line IV—IV of FIG. 1. The dispenser 3 of the embodiment is a conveyor means including an endless belt 26 trained around pulleys 16 and driven by a motor to discharge ampules A that have dropped off the receiver 2 in its aligned direction. The ampule catcher 4 has its bottom plate slightly inclined toward the discharge means 40 to feed discharged ampules A into the discharge means 40. Ampules A roll on the bottom plate of the receiver 2, fit one after another into grooves 43 formed in the rotating rotor 41 of the discharge means 40, and are discharged one by one through a discharge port 44 shown in FIG. 4.

As shown, a pair of sensors PH are provided at the discharge port 44 to detect the passage of ampules.

An ampule sensor PH comprising a light emitter and a light receiver is provided outside the dispenser 3. The sensor PH detects any ampule on the belt 26 from the fact that light emitted from the emitter toward the receiver is interrupted by the ampule on the belt.

Figure 5:
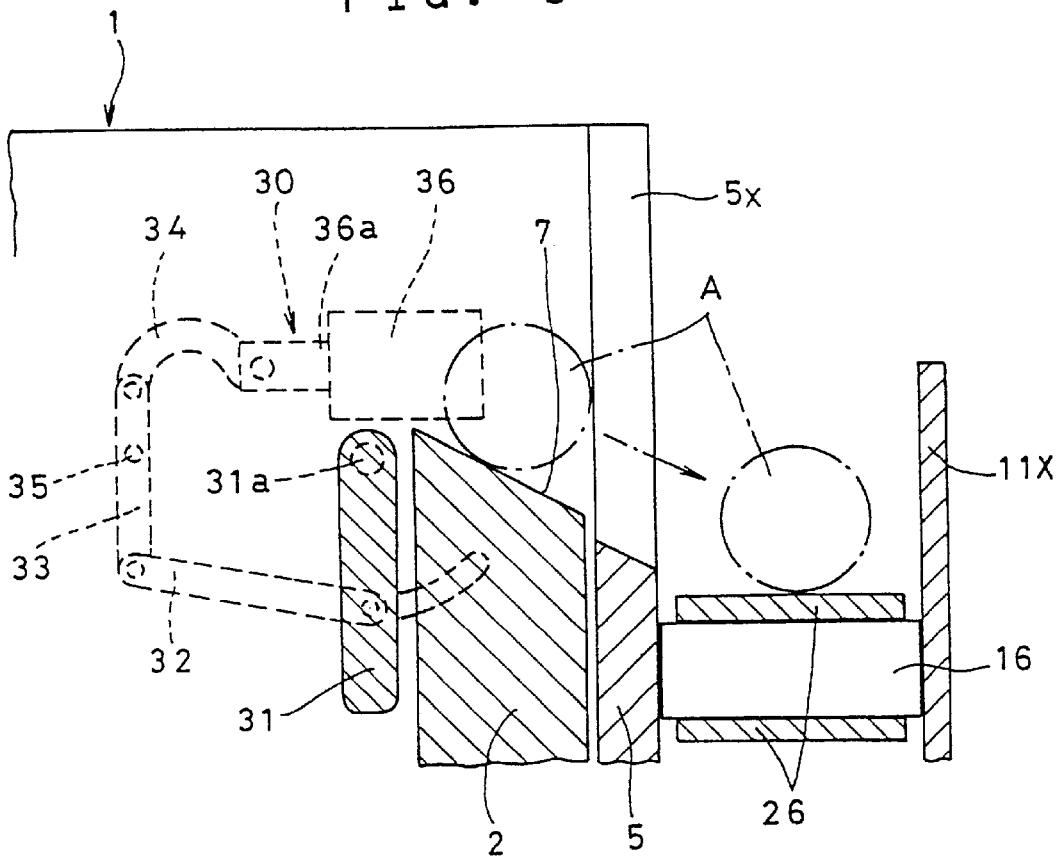
FIG. 5 is a schematic view of an ampule dropper.

FIG. 5 shows an example of the ampule dropper 30. It serves to drop any ampules A that stand erect on the ampule receiver 2 so that all the ampules are fed in an orderly manner.

The ampule dropper 30 includes a solenoid 36 having a rod 36*a* to which is coupled one end of a link 34 having its other end coupled to one end of a link 33 pivotable about a pin 35 and having its other end coupled to one end of a link 32 coupled at its other end to a plate 31 pivotable about a pin 31*a*. By reciprocating the rod 36*a*, the links 32, 33, 34 pivot about the pin 35, thus pivoting the plate 31 about the pin 35 to drop any ampules standing upright on the ampule receiver 2.

Figure 6B:
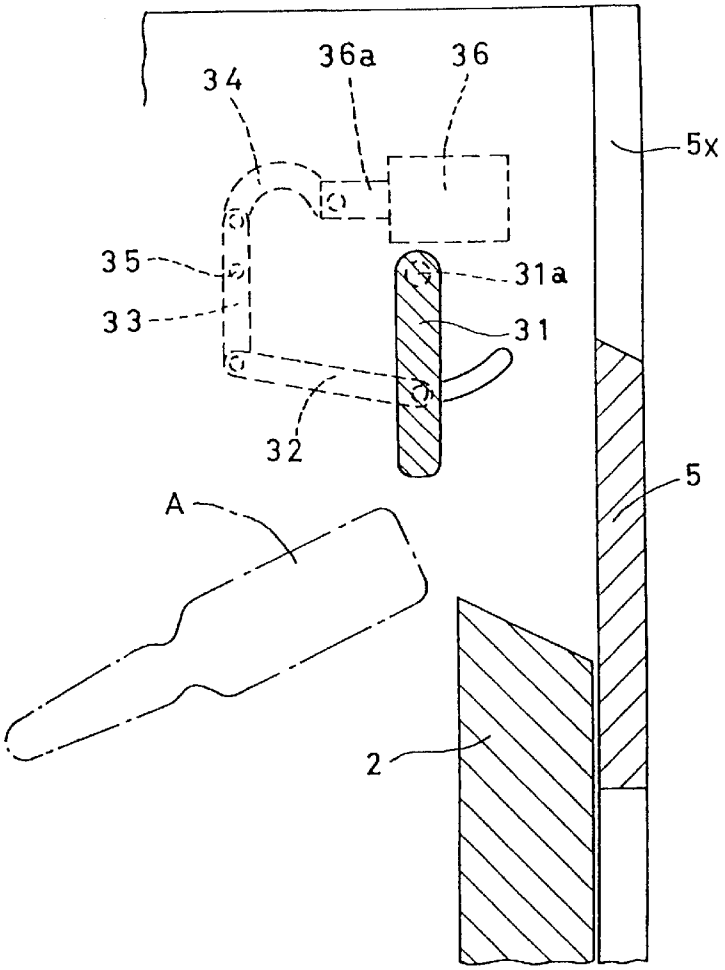
FIGS. 6A–6B are views illustrating the operation of the ampule dropper.
Figure 6A:
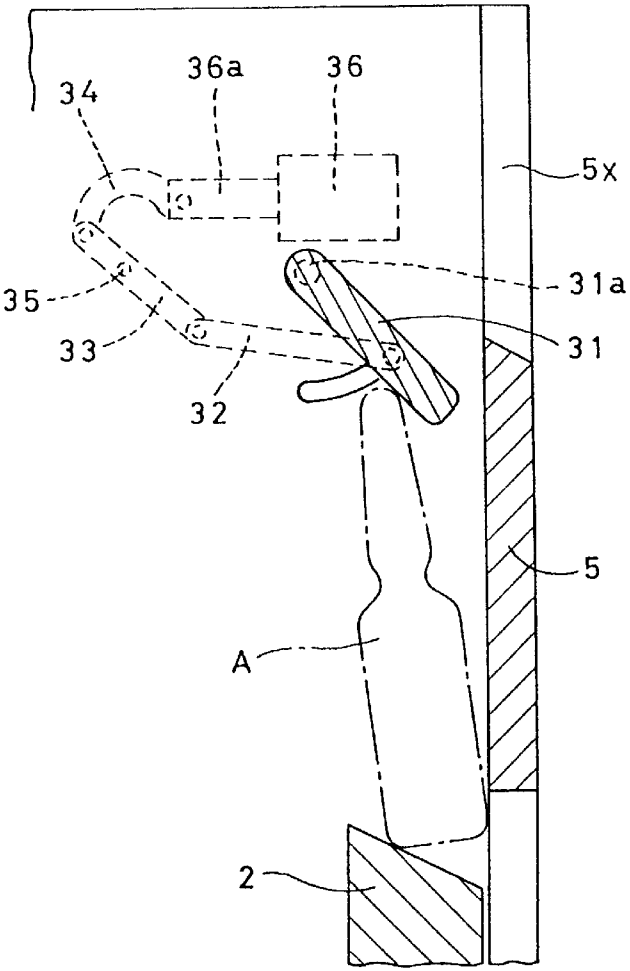

FIGS. 6A–6B illustrates how ampules are dropped by the ampule dropper 30. While the dropper 30 is not activated, the ampule dropping plate 31 stands erect as shown in FIGS. 1 and 5. When the ampule feeder begins feeding ampules, the ampule dropping plate 31 is inclined to wait for the ampule receiver to be raised.

When the ampule receiver 2 rises, if ampules are found out to be standing erect thereon by an operator or a sensor, an input signal or a detection signal is entered to pivot the ampule dropping plate 31 by activating the solenoid 36, thereby dropping any standing ampules as shown in FIG. 6B.

The operation of the ampule feeder of the first embodiment is described below. Many ampules A are stored randomly in the container 1. In response to a trigger signal for starting the feeding of ampules, the control unit lowers the ampule receiver 2 to bring its top surface 7 to the same level as the bottom plate 1*a*.

Some of the ampules A on the bottom plate 1*a* will move onto the top surface 7 of the ampule receiver 2. In this state, the ampule receiver 2 begins to rise. While the ampule receiver is rising, any ampules that are only partially on the top surface 7 are dropped, so that only ampules that are completely on the top surface 7 and thus arranged in an orderly manner are kept on the top surface 7. But some ampules may be kept on the top surface 7 while standing upright. The ampule dropper 30 drops such ampules.

When the ampule receiver 2 is raised to the highest level, the lower end of the inclined top surface 7 of the ampule receiver clears the top end of the side wall 5, so that ampules A on the inclined top surface 7 roll down by gravity onto the endless belt 26 of the dispenser 3. Ampules A on the belt 26 are fed by the belt 26 and discharged from the delivery end of the belt 26 into the ampule catcher 4. From the ampule catcher 4, ampules are fed into the discharge means 40 and discharged therefrom.

(Second Embodiment)

Figure 8:
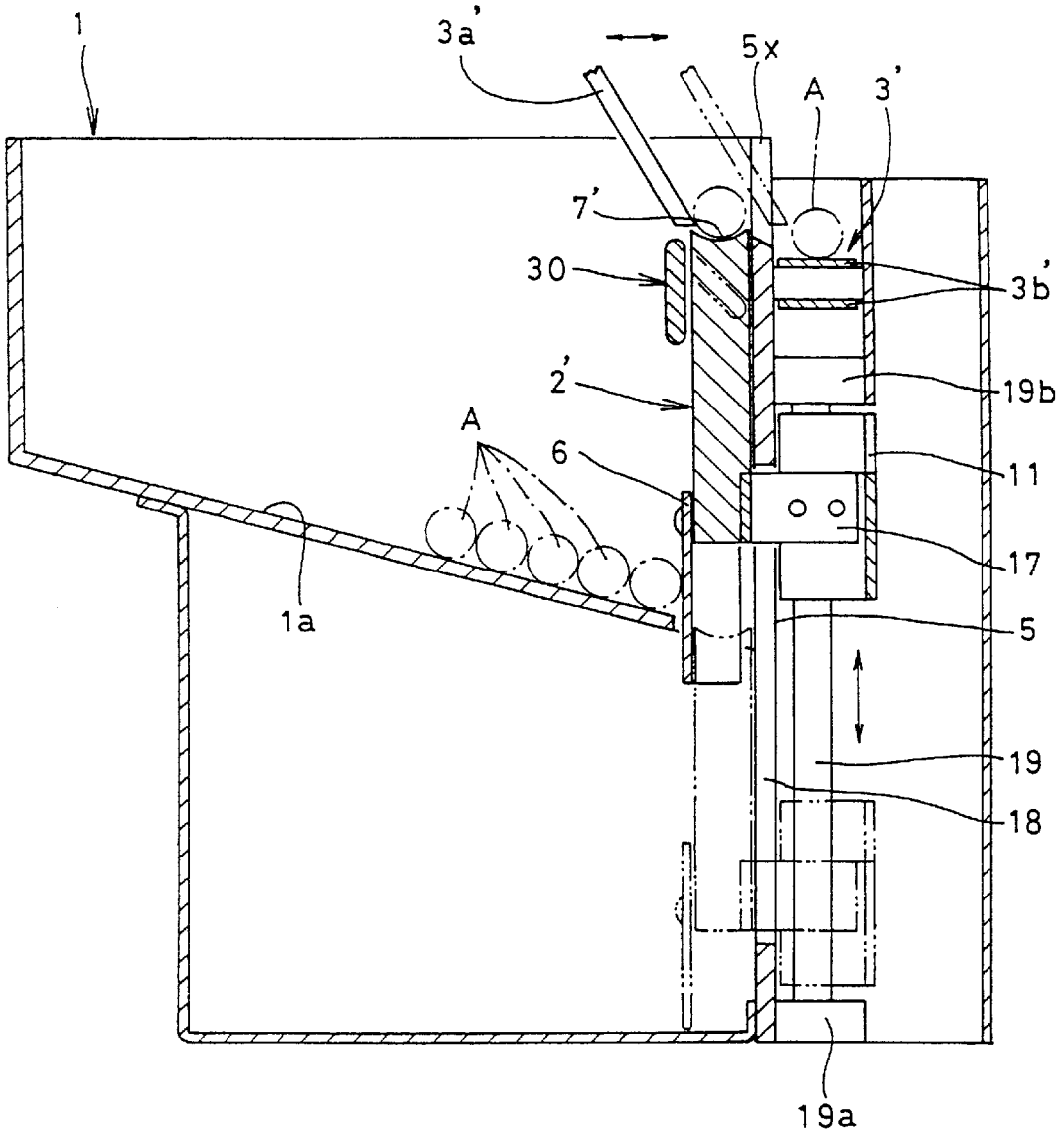
FIG. 8 is a partial sectional view of an ampule feeder of a second embodiment.

FIG. 8 is a main section of an ampule feeder of a second embodiment. Basically, this embodiment is the same as the first embodiment. Description is thus made mainly of what differs from the first embodiment. Like parts are denoted by like numerals.

As shown, an ampule receiver 2' has a horizontal ampule-receiving top surface 7' which is recessed so that ampules A can be received reliably thereon. Ampules on the recessed top surface 7' cannot be dispensed simply by raising the receiver. Thus, in this embodiment, a dispenser 3' is provided which includes an ampule kicker 3*a'* and a dispense driver 3*b'* comprising an endless belt 26 as used for the dispenser 3 of the first embodiment. The kicker 3*a'* is substantially as long as the ampule receiver 2' and reciprocated by an unillustrated drive means in directions shown by arrows.

Otherwise, this embodiment is structurally the same as the first embodiment. Operation-wise, this embodiment differs from the first embodiment only in that ampules on the top surface 7' are kicked down by the kicker 3*a'*.

(Third Embodiment)

Figure 9:
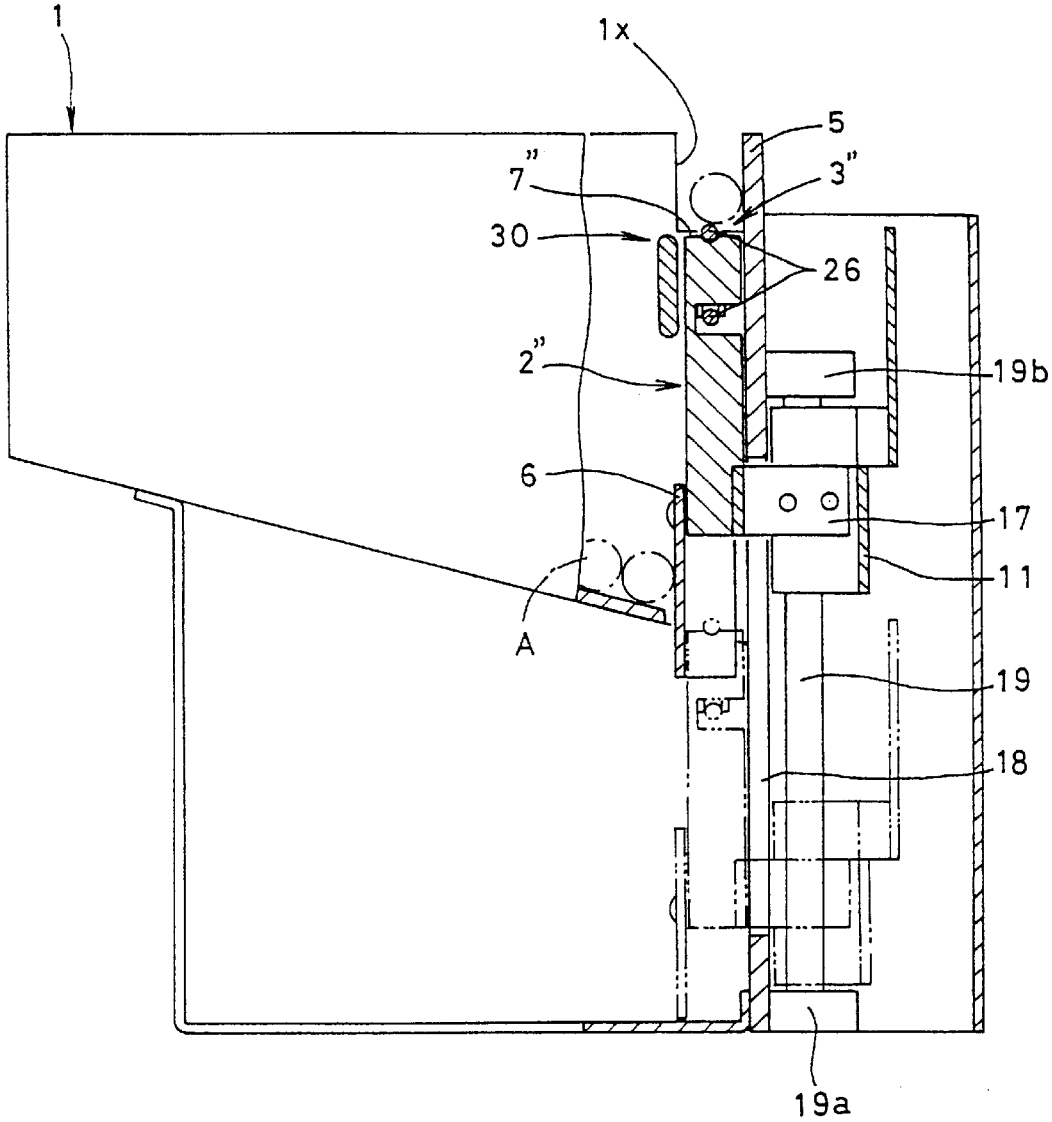
FIG. 9 is a partial section of an ampule feeder of a third embodiment.
Figure 10:
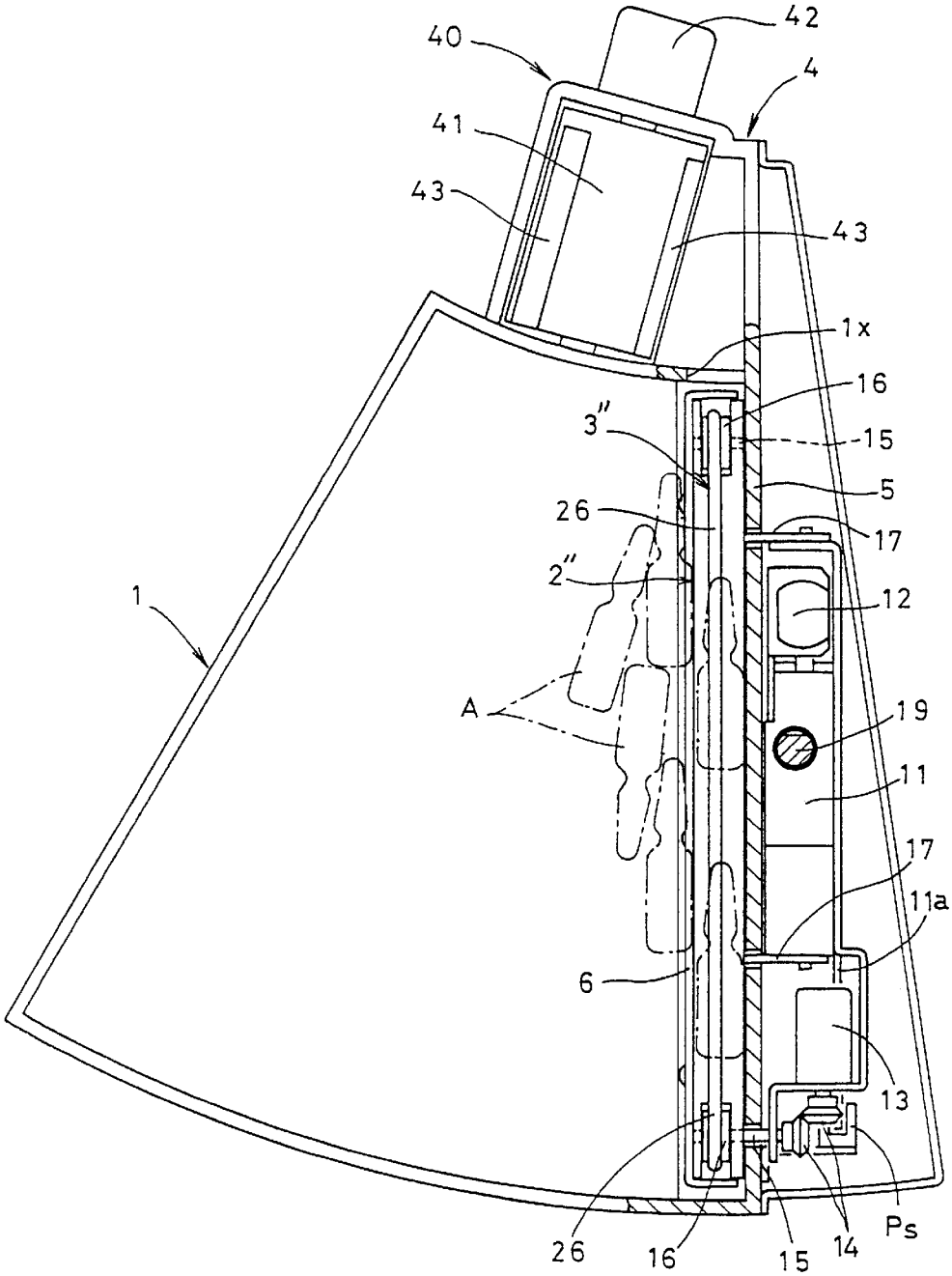
FIG. 10 is a plan view of the ampule feeder of FIG. 1.

FIGS. 9 and 10 are a main section and a plan of an ampule feeder of a third embodiment. Basically, this embodiment is the same as the first embodiment. The following description is therefore restricted mainly to what differs from the first embodiment. Like numerals designate like elements.

This embodiment differs from the first embodiment in that an ampule receiver 2" has a flat ampule-receiving top surface 7", and that an endless belt 26 as a dispenser 3" is mounted on the top edge of the ampule receiver 2". Since the dispenser 3" defines an ampule discharge passage extending in the direction in which ampules are arranged, there is no need to provide an ampule discharge passage outside of the side wall 5. The side wall 5 thus extends to the same height as the other side wall of the container 1. But the side wall 5 is formed with a cutout 1*x* as an ampule dispensing port at a portion where the discharge passage intersects a wall extending perpendularly to the side wall 5.

In this arrangement, ampules A raised by the ampule receiver 2" in an orderly arranged manner are moved horizontally laterally by the endless belt 26 and dispensed. This embodiment is otherwise no different in both structure and operation from the first embodiment.

(Fourth Embodiment)

Figure 11:
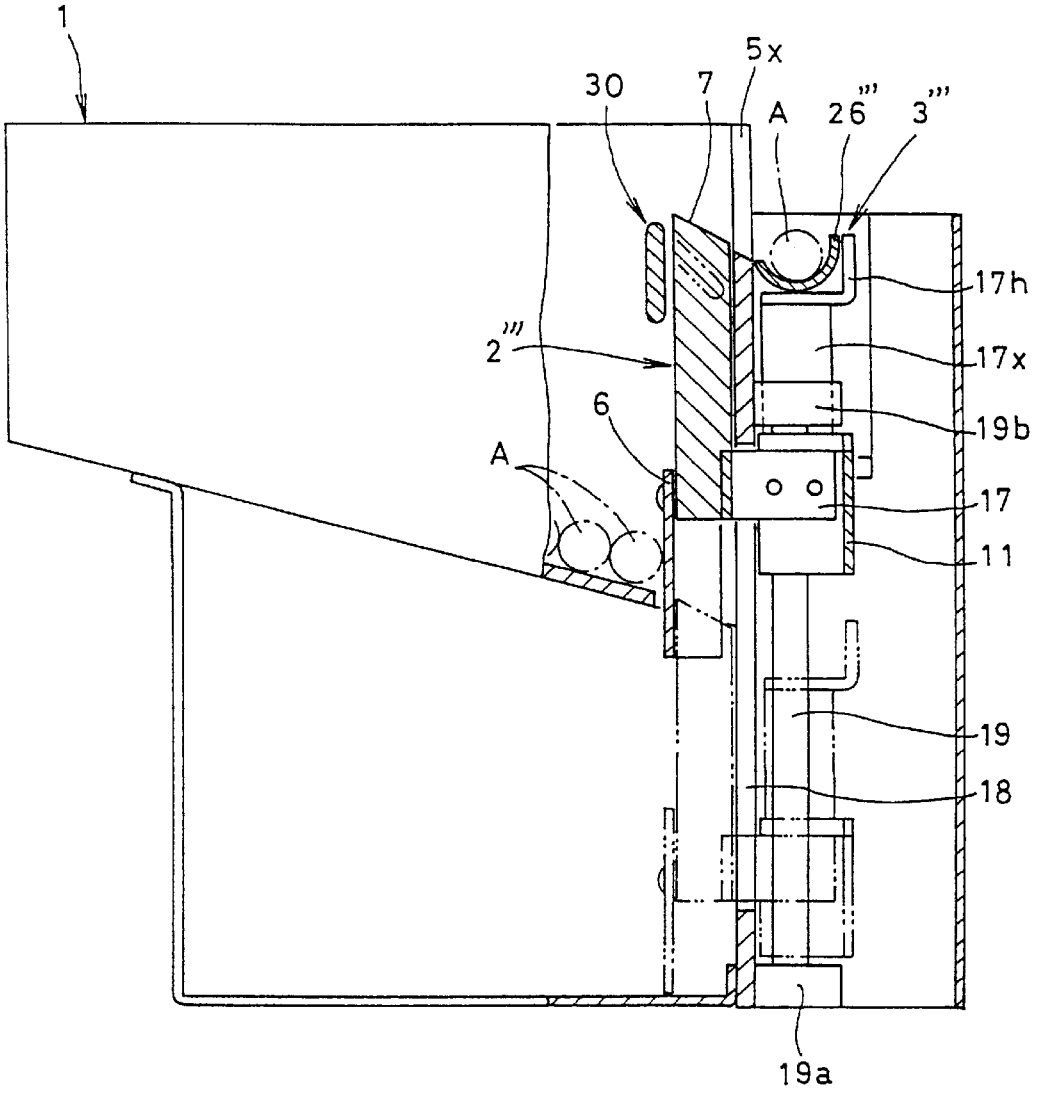
FIG. 11 is a partial sectional view of an ampule feeder of a fourth embodiment.
Figure 12:
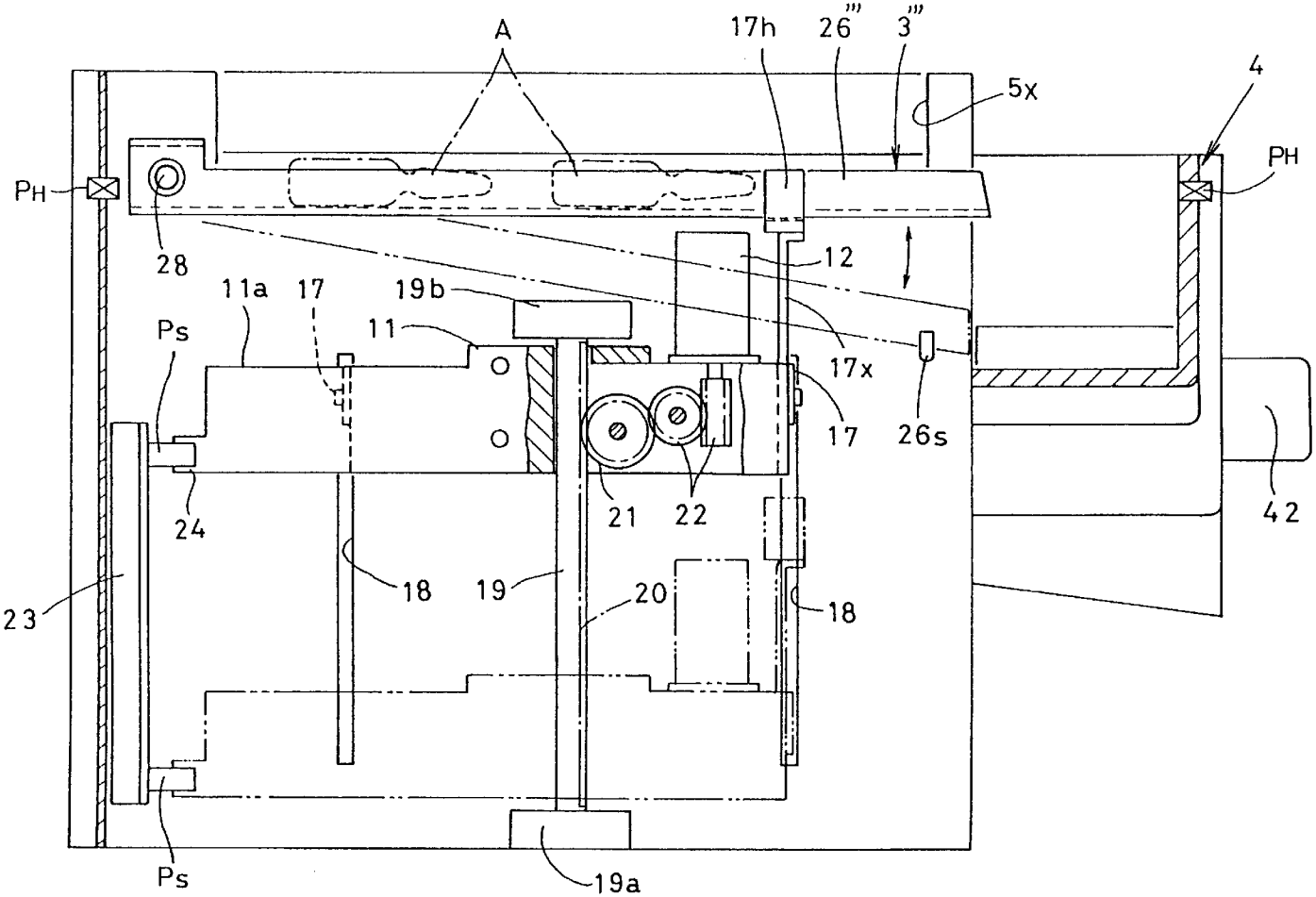
FIG. 12 is a side view of the ampule feeder of FIG. 11.

FIGS. 11 and 12 are a main section and a side view of an ampule feeder of a fourth embodiment, in which are used a container 1 and an ampule receiver 2 that are exactly the same as those of the first embodiment. But a dispenser 3" and a drive unit for the ampule receiver 2 are slightly different.

As shown, the dispenser 3"' is a semicylindrical ampule guide 26"' having one end thereof pivotally supported by a rotary shaft 28 and its portion near the other end supported on an arm head 17*h* provided on top of a support arm 17*x* provided at one end of the support plate 11 which is moved up and down by the motor 12. The guide 26"' is thus pivoted about the shaft 28 by the motor 12. As the ampule receiver 2 is raised, the ampule guide 26"' is pivoted from an inclined position shown by chain line in FIG. 12 to a horizontal position shown by solid line. When the ampule receiver 2 is raised to the highest position, ampules A thereon roll down into the now horizontal ampule guide 26"'. Then, the guide 26"' is inclined to dispense the ampules supported thereon as the ampule receiver 2 is lowered.

Outside a mounting plate 5"', an elevator means similar to that of the first embodiment is provided. Numeral 26*s* indicates a stopper.

(Fifth Embodiment)

Figure 13:
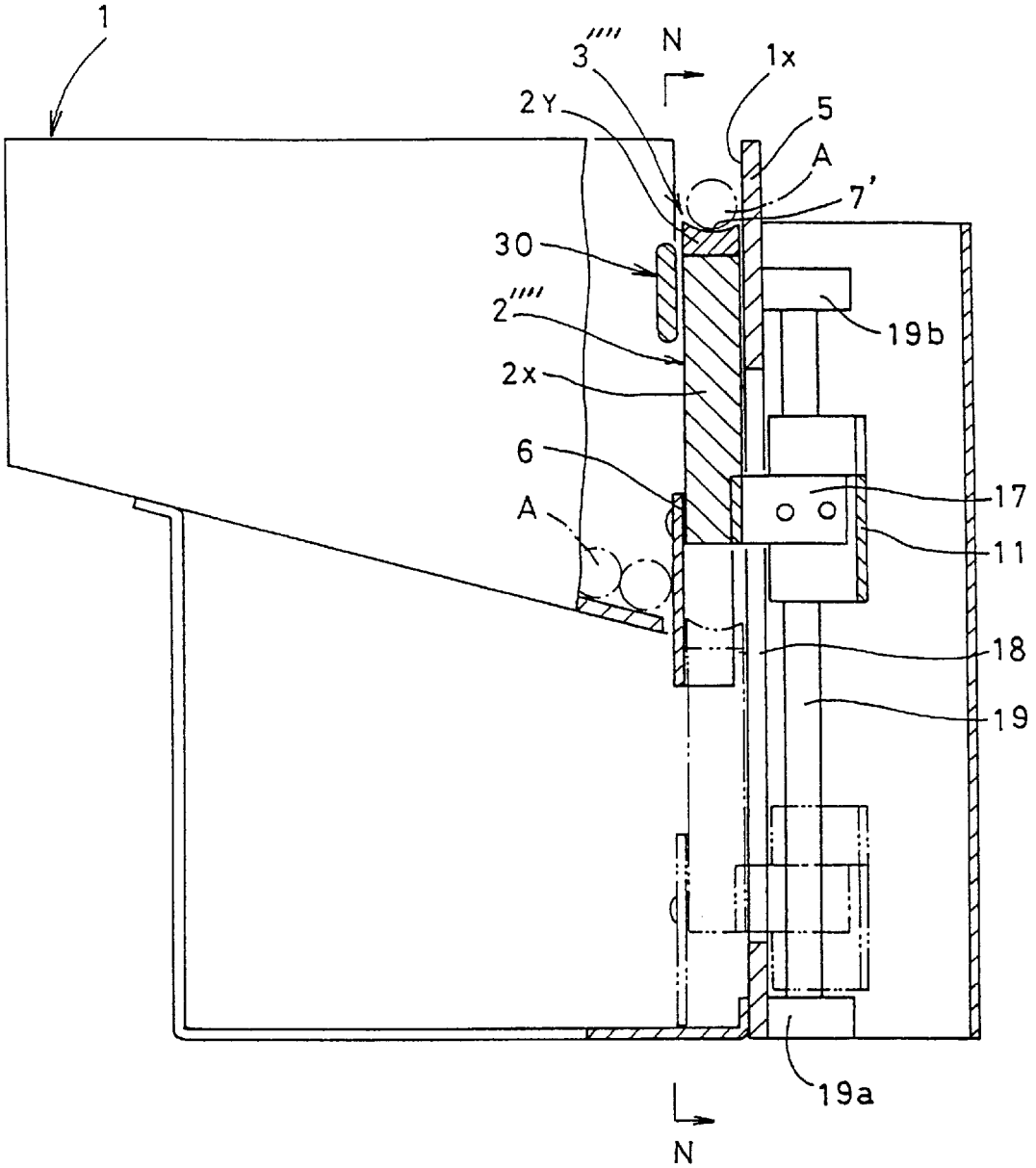
FIG. 13 is a partial sectional view of an ampule feeder of a fifth embodiment.
Figure 14:
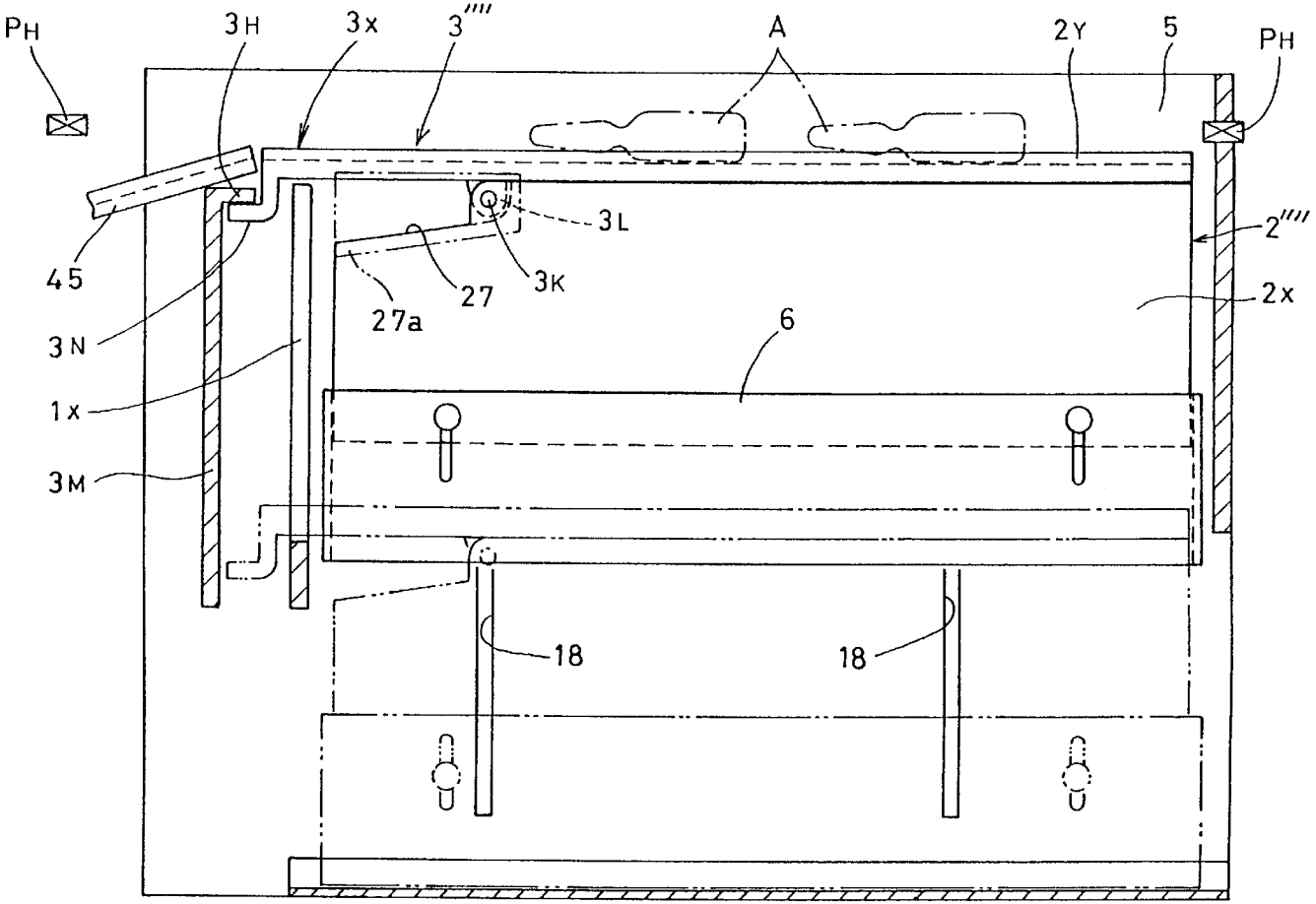
FIG. 14 is a side view as viewed in the direction of arrows N—N of FIG. 13.
Figure 15:
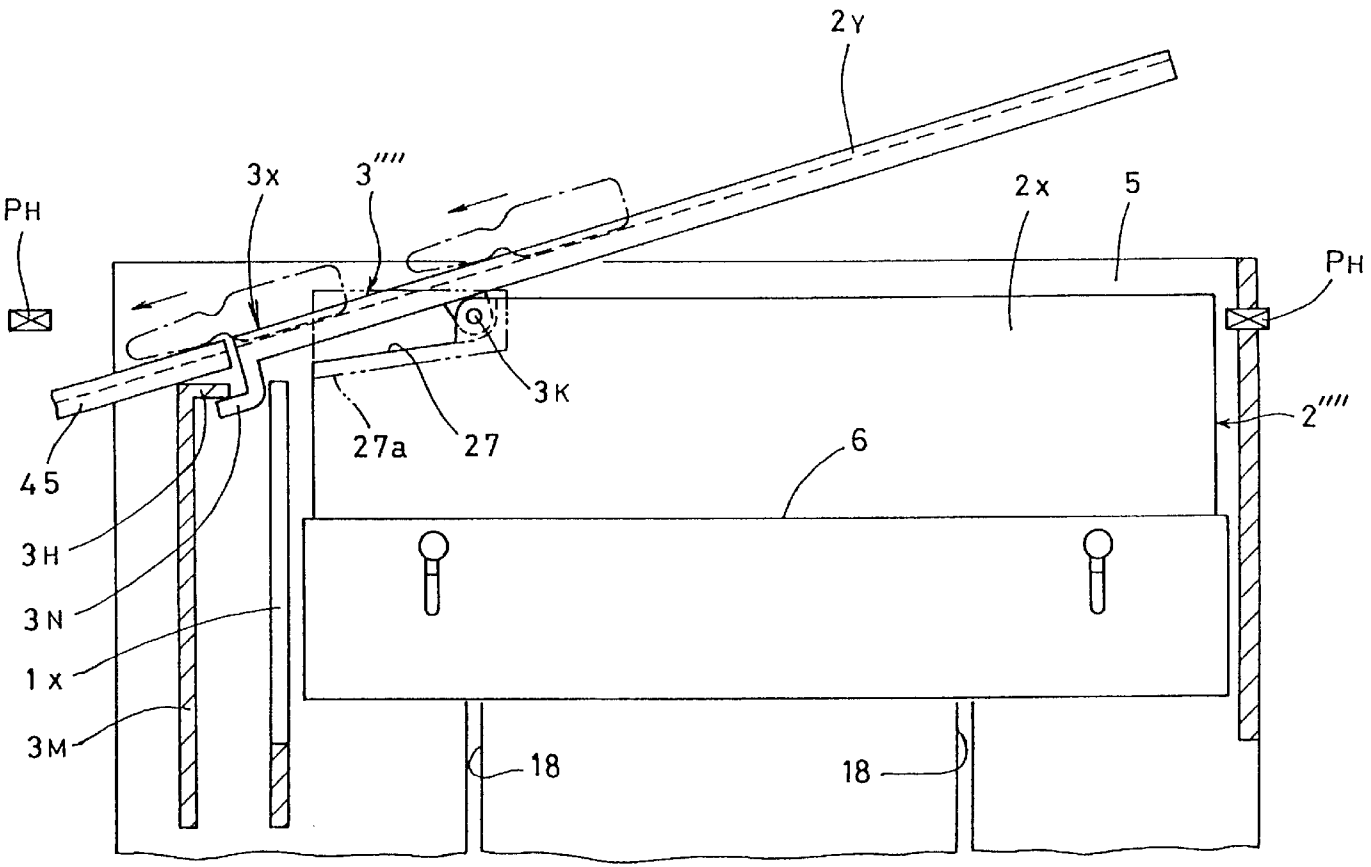
FIG. 15 is a view illustrating the operation of the fifth embodiment.

FIG. 13 is a main section of an ampule feeder of a fifth embodiment. FIG. 14 is a section taken along line N—N of FIG. 13. The ampule feeder of this embodiment includes an ampule receiver 2"" comprising a lower member 2*x* and an upper member 2*y* detachably mounted on the lower member 2*x*, and a dispenser 3"" comprising the upper member 2*y* and a means 3*x* (FIG. 14) for inclining the upper member 2*y* to drop ampules A.

The lower member 2*x* is provided simply to raise the upper member 2*y* and cannot arrange ampules. The upper member 2*y* is substantially as wide as the lower member 2*x*, and has a recessed top surface 7'. Thus, the upper member 2*y* has both the functions of arranging and dispensing ampules A.

As shown in FIG. 14, the lower member 2*x* has a cutout 27 at one end. On its back, the upper member 2*y* has a protrusion 3L received in the starting end of the cutout 27 and engaging the lower member 2*x* by means of a pin 3*k*. The upper half member 2*y* is thus pivotable about the pin 3*k*. The means 3*x* includes the pin 3*k* and a hook 3H provided at the top of an engaging bar 3M. At the end near the hook 3H, the upper member 2*y* has an L-shaped arm 3N adapted to engage the hook 3H, thus preventing the upper portion 2*y* from being raised by the lower member 2*x* to a level higher than the level shown. When the lower member 2*x* is raised further from the position shown, the upper member 2*y* pivots and inclines by a predetermined angle. A cover 27*a* is provided to prevent ampules from falling through the cutout 27. A groove 1*x* is formed in the side wall at its portion along which the upper member 2*y* is moved up and down.

Figure 16:
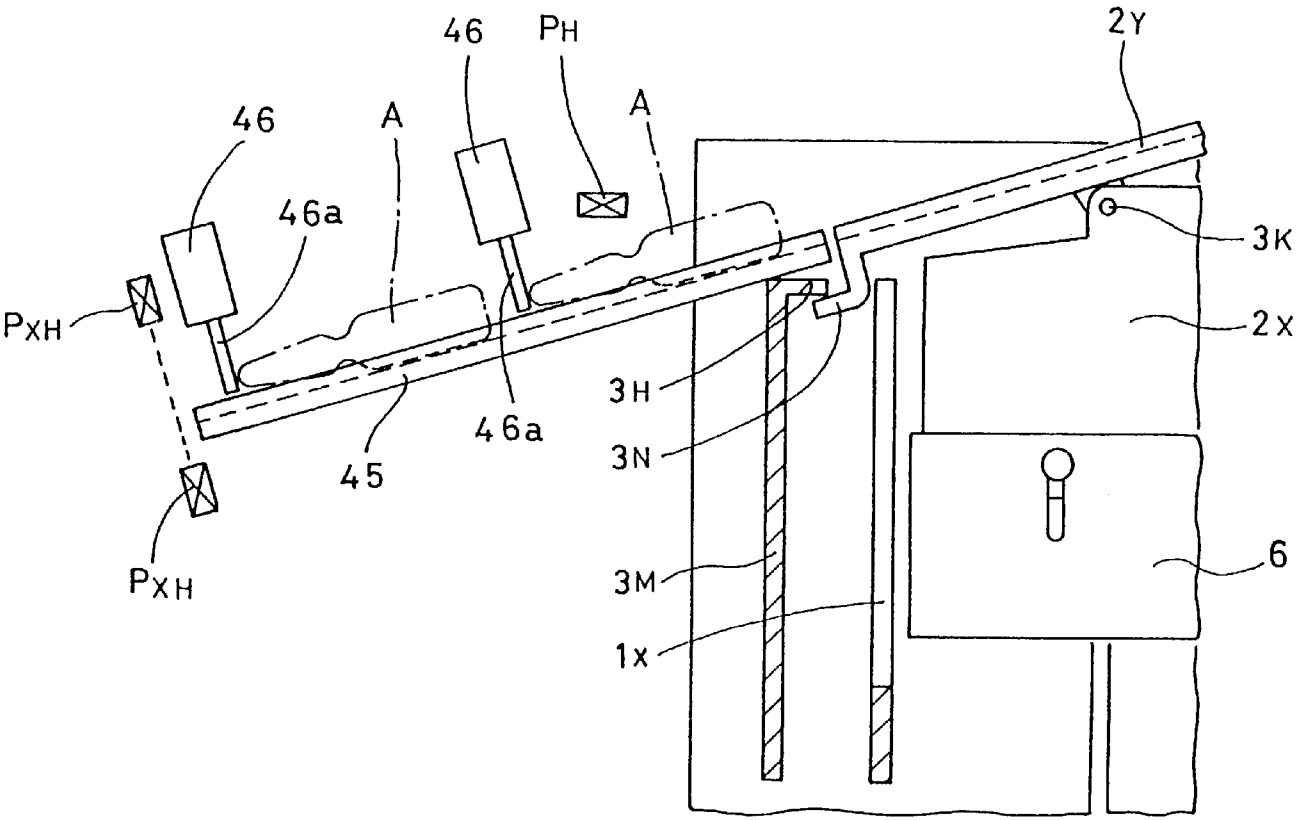
FIG. 16 is a schematic view of another ampule storage/supply means.

FIG. 16 shows an ampule feeder of a fifth embodiment. This feeder dispenses ampules A from a dispenser 3"", stores them temporarily until a predetermined number of them collect, and supplies them while confirming the passage of each ampule.

A plurality of (two in the embodiment) ampules A discharged back to back onto a discharge chute 45 are stopped by protruding pushrods 46*a* of solenoids 46 over the chute 45. Then, the solenoid 46 near the discharge end of the chute 45 is opened to drop the front one of the two ampules on the chute. A sensor PXH detects the falling ampule to count the number of ampules.

Instead of the rotor type ampule storage/supply means shown in FIG. 2, the means shown in FIG. 16 can be used in any of the embodiments.

Figure 17A:
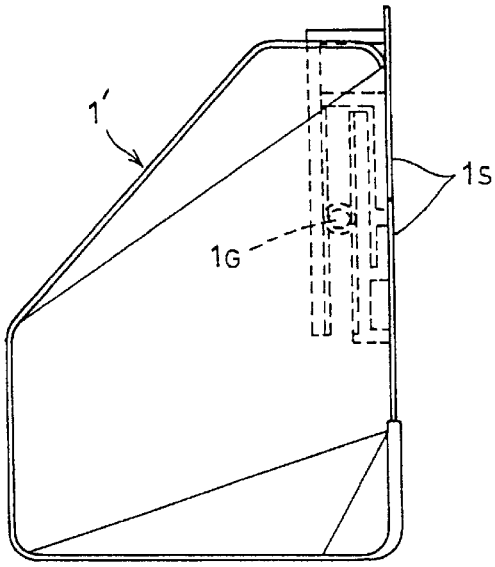
FIGS. 17A–17B show in plan and side elevation a detachable ampule container with shutters.

While the ampule storage container 1 in any of the above five embodiments is fixed to the device, FIGS. 17–19 show a detachable ampule storage container 1'.

Figure 19A:
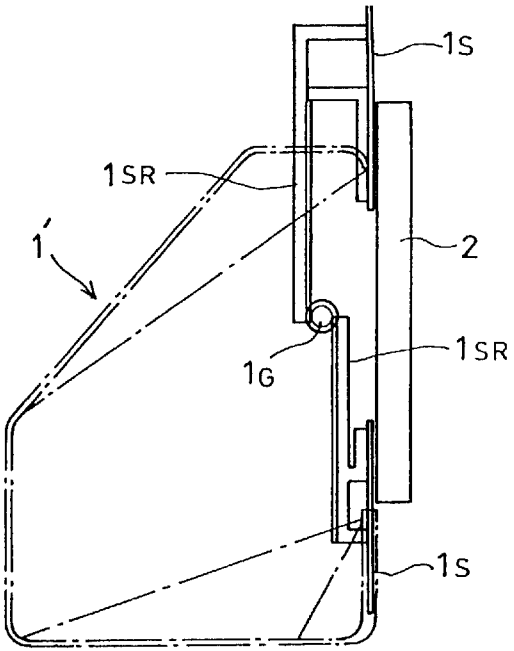
FIGS. 19A–19C illustrate the relationship between the mounting and dismounting of the ampule container and the movement of the shutters.
Figure 19B:
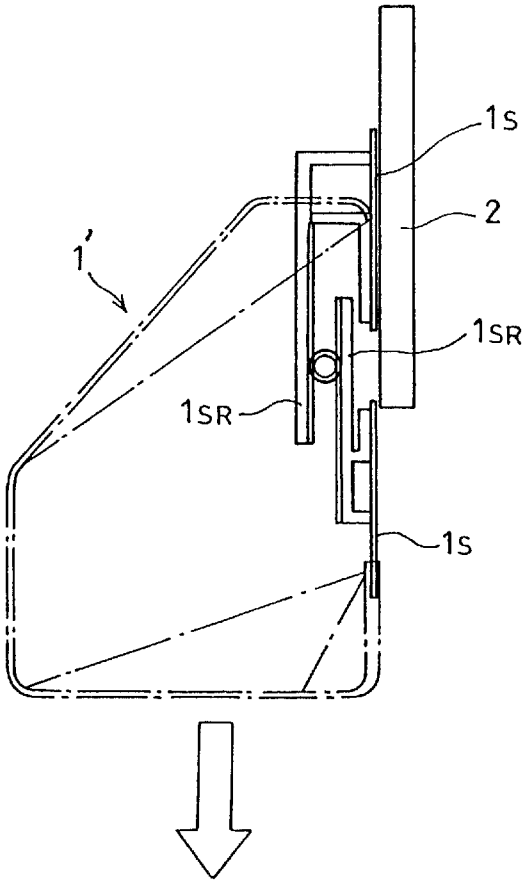
Figure 19C:
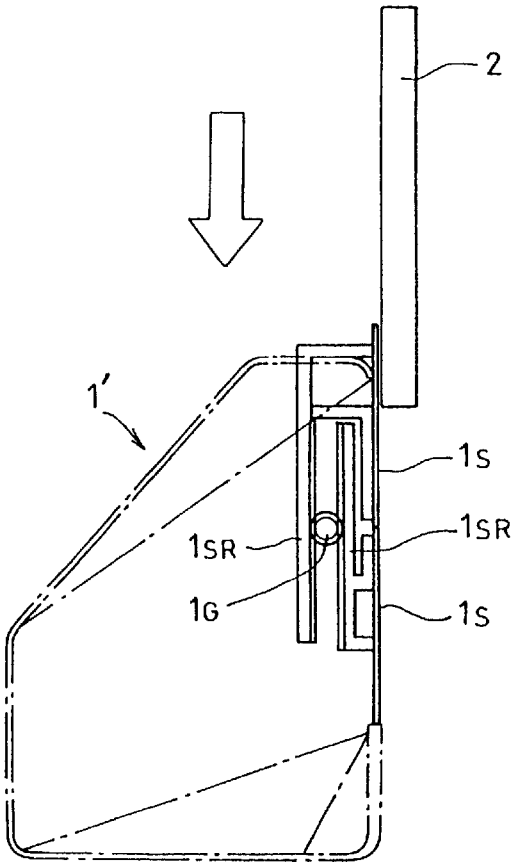

The ampule storage container 1' is detachable from a shelf of the ampule feeder. As shown in FIGS. 19A–19C, the container has shutters is provided at the boundary between the ampule receiver 2 and the ampule storage container 1'.

When the container 1' is set in the ampule feeder, the shutters Is will open, and when it is slid out of the ampule feeder, the shutters Is will close, separating the ampules A in the container from the ampule receiver 2.

Figure 18B:
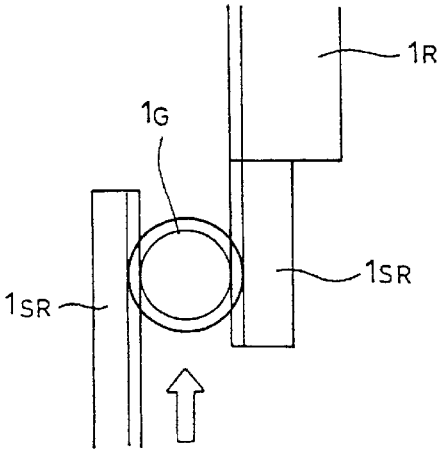
FIGS. 18A–18B show how the shutters are opened and closed.
Figure 18A:
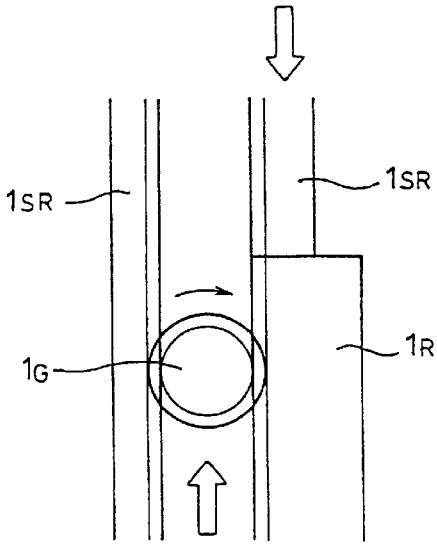

Each shelf of the ampule feeder has a guide, not shown, and a rack 1R adapted to mesh with a gear 1G provided on the container 1'. As the container 1' is slid into a shelf of the feeder, the gear 1G meshes with the rack 1R and rotates as shown in FIGS. 18A, B to mount the container 1'.

As the gear 1G rotates, shutter racks 1SR provided opposite the gear 1G are moved away from each other. As the shutter racks 1SR move, FIG. 18B, the shutters is are moved away from each other and opened. Ampules in the container 1' can thus be tranferred into the ampule receiver 2.

Figure 17B:
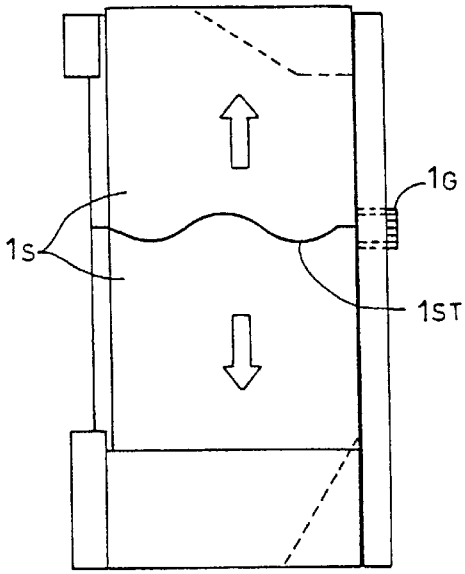

The shutters 1*s* are guided by the container 1'. The shutters 1*s* have preferably corrugated edges 1ST as shown in FIG. 17B rather than straight edges. Corrugated edges 1ST are less likely to sandwich and break ampules A than straight edges.

Figure 20:
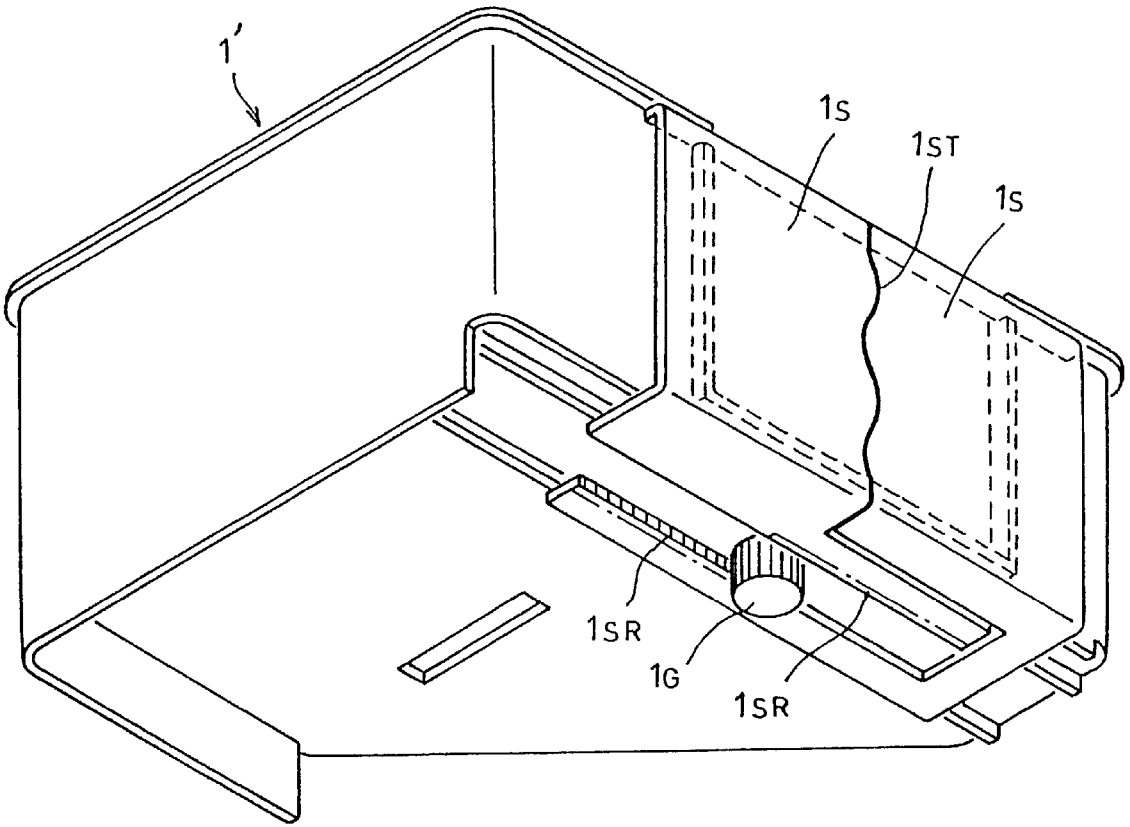
FIG. 20 is a perspective view of the ampule container provided with the shutters.

FIG. 20 is a perspective view of the detachable ampule container 1', as viewed obliquely from the bottom. As shown, the gear 1G is in mesh with the shutter racks 1SR. When the container 1' is dismounted from the feeder, the ends 1ST of the shutters 1S are closed. The gear 1G is adapted to mesh with the shelf rack 1R under the racks 1SR.

(Sixth Embodiment)

Figure 21:
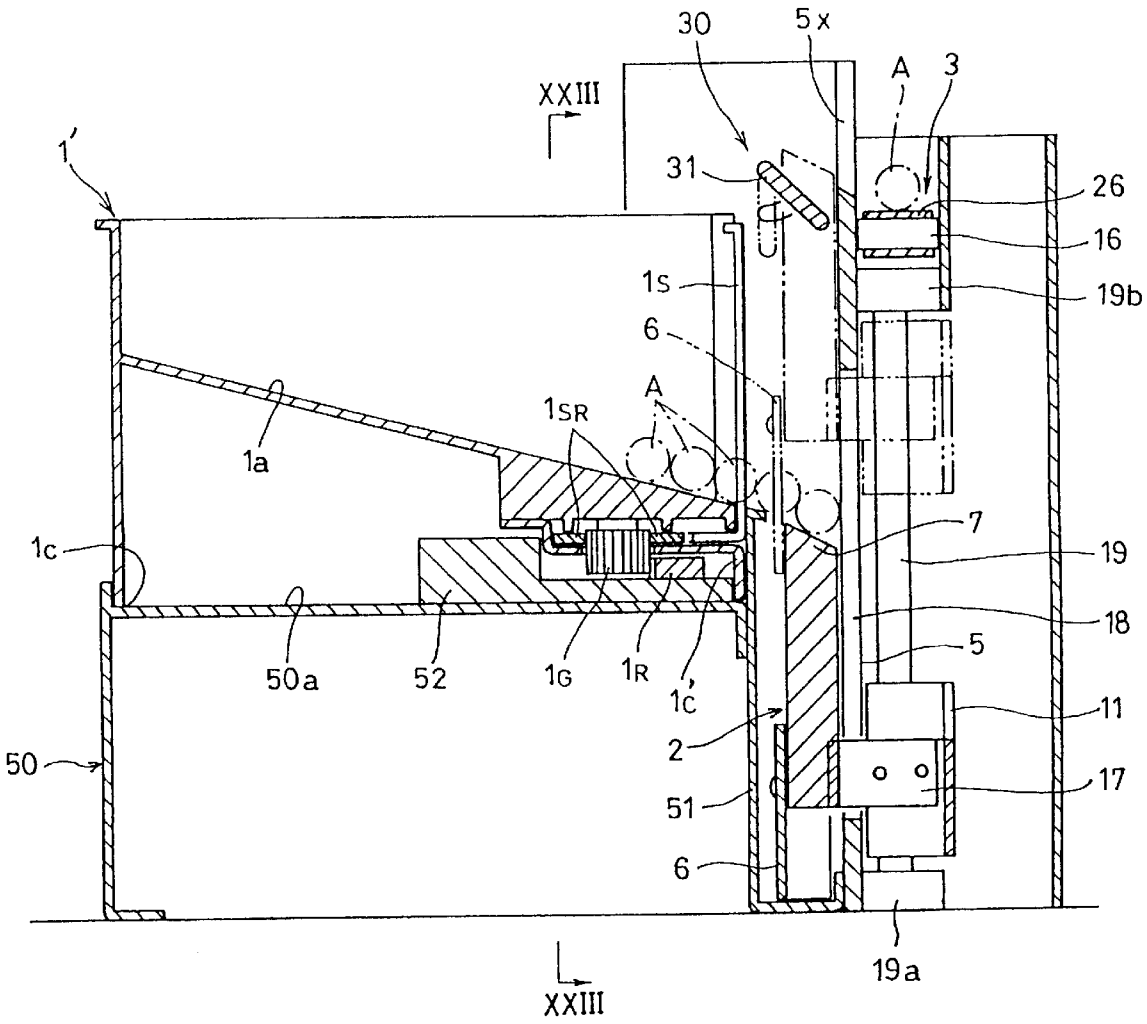
FIG. 21 is a sectional view of an ampule feeder of a sixth embodiment.

FIGS. 21–24 show a sixth embodiment, in which the detachable ampule storage container 1' is used in the device of the first embodiment. FIG. 21 is a main section corresponding to FIG. 1. As shown, a shelf 50 for the ampule container 1' is mounted to one side of the ampule receiver 2. The ampule container 1' is horizontally slid in and out on the shelf, guided by its bottom leg 1*c* and bottom leg plate 1*c'*.

A partitioning shelf side plate 51 is provided between the shelf 50 and the ampule receiver 2. Inside of the shelf side plate 51, the shutters 1*s* are slidably opened and closed in the longitudinal direction of the ampule receiver 2. Mounted on a top surface 50*a* of the shelf 50 is a support plate 52 to which is fixed the rack 1R adapted to mesh with the gear 1G when inserted. Its rotation is transmitted to the shutter racks 1SR, opening the shutters 1*s,* in the manner already described.

The illustrated embodiment differs from the first embodiment only in that the ampule storage container 1' is detachable. Otherwise, this embodiment is basically the same as the first embodiment. Like members are denoted by like references and not described. The ampule container 1' is slightly different in shape (compare FIGS. 2 and 22) but not in its basic function.

Figure 24:
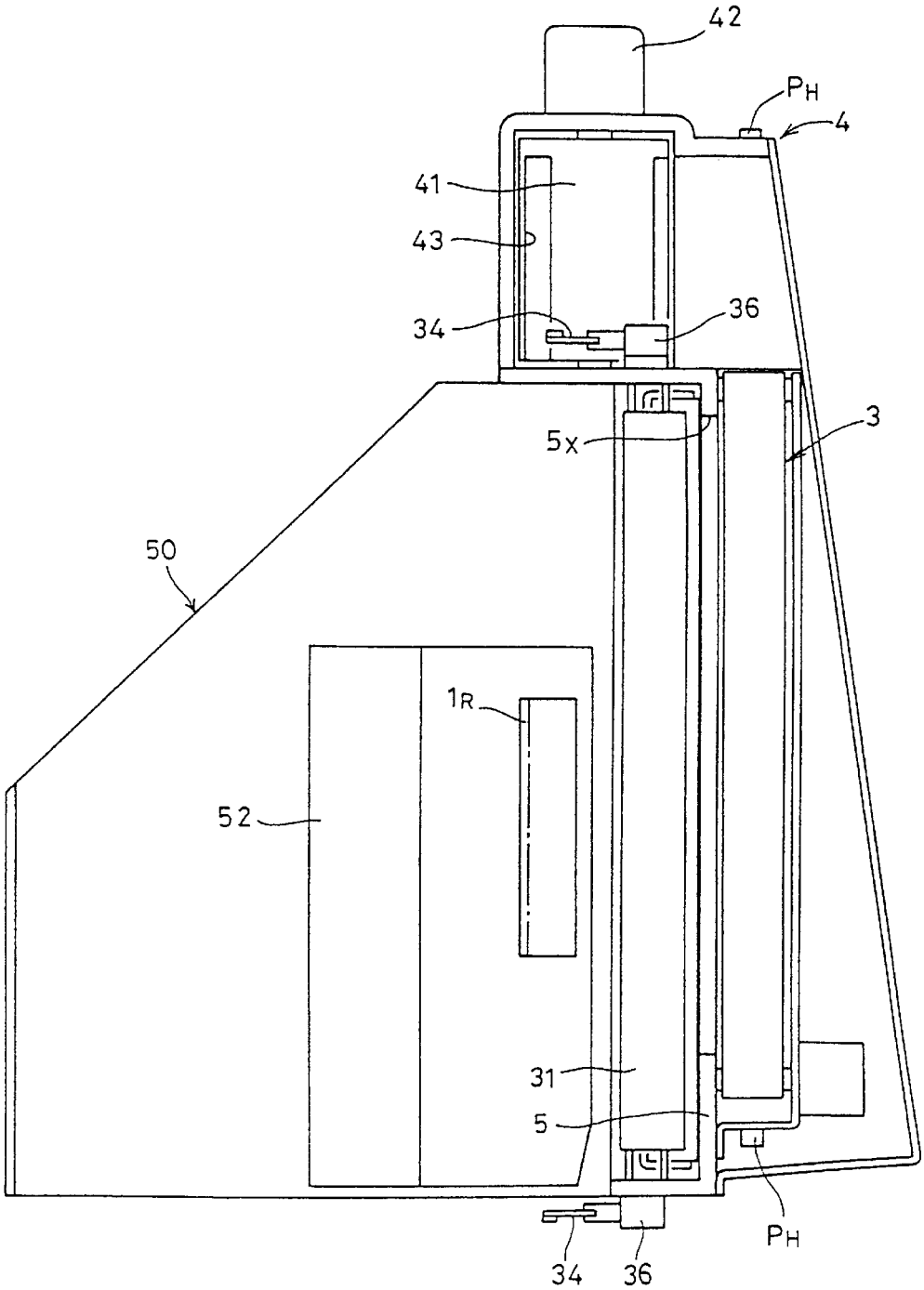
FIG. 24 is a plan view with the ampule container removed.
Figure 25:
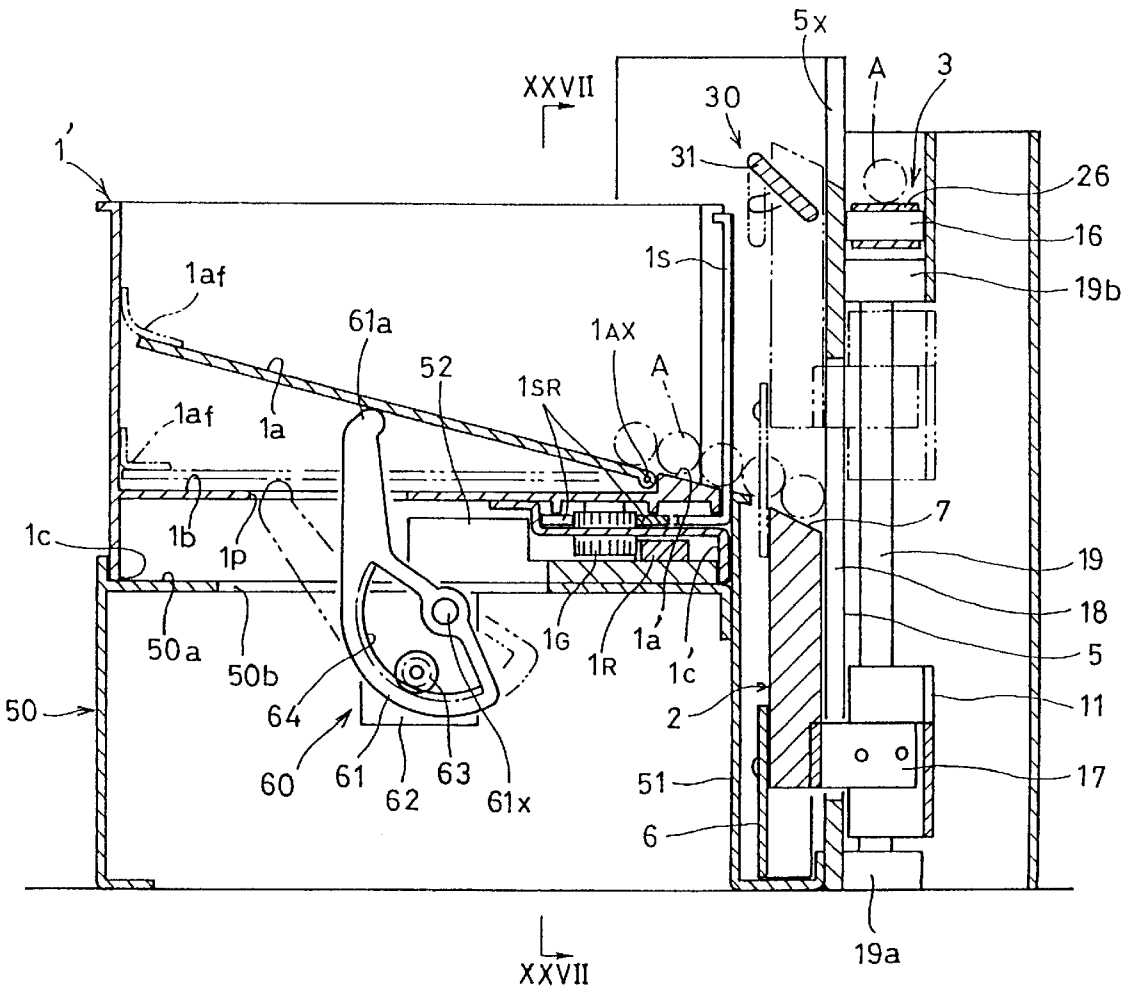
FIG. 25 is a partial sectional view of an ampule feeder of a seventh embodiment.

FIG. 24 shows a plan with the ampule container 1' removed from the device. The shelf rack 1R is mounted on the support plate 52 on the shelf 50. In the sixth embodiment, the detachable ampule container 1' is used in the device of the first embodiment. But one would recognize without the need to show detailed drawings, that the container 1 can also be used in the device of any of the second to fifth embodiments.

Figure 22:
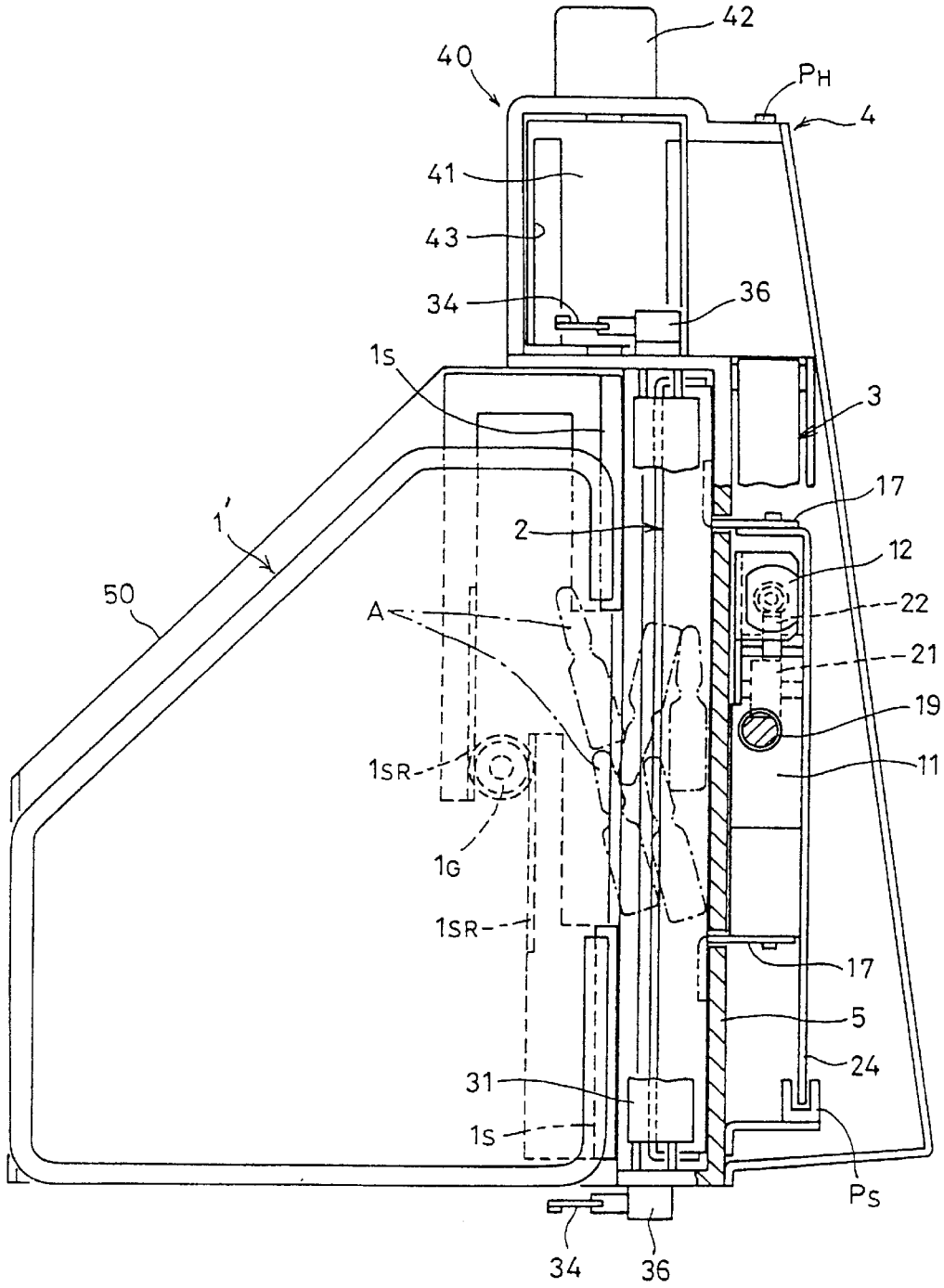
FIG. 22 is a plan view of the ampule feeder of FIG. 21.
Figure 23:
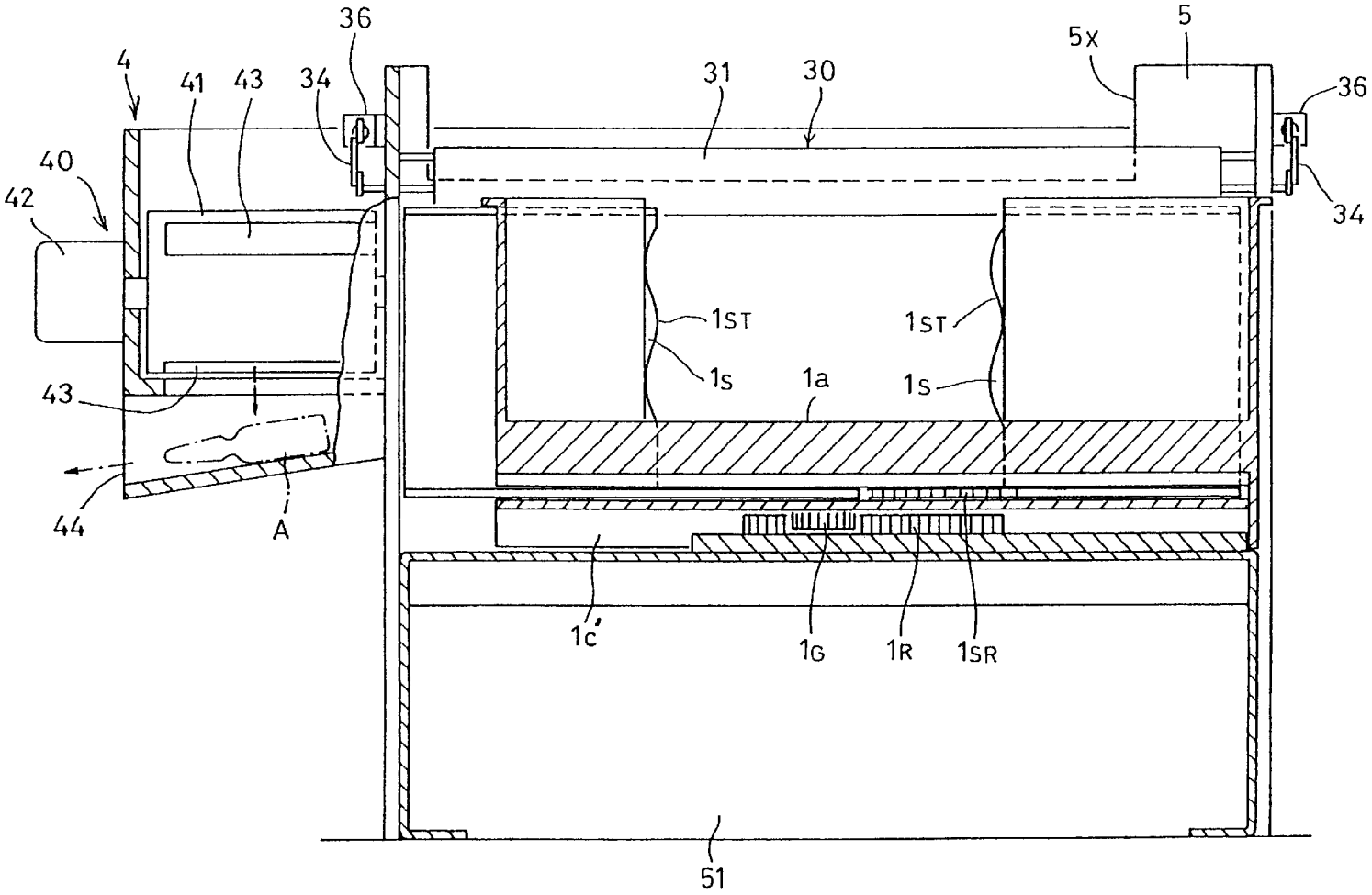
FIG. 23 is a side view as viewed in the direction of arrows XXIII—XXIII of FIG. 21.

To set the ampule container 1' of this embodiment as shown in FIG. 22, an operator puts the ampule container 1' on the shelf 50, and pushes it in until the gear 1G at the bottom of the ampule container 1' meshes with the shelf rack 1R.

The shelf rack 1R has such a length that the gear 1G meshes with the rack 1R and its rotation is transmitted to the shutter racks ISR until the shutters racks ISR are moved away from each other and the shutters 1S open as shown in FIG. 22. Thus, by simply pushing the ampule container 1' onto the shelf 50, the container is set while being guided in the direction of length of the ampule receiver 2.

(Seventh Embodiment)

FIGS. 25–28 show a seventh embodiment, in which the bottom plate 1*a* of the ampule container 1' is inclinably provided. FIGS. 25–28 correspond, respectively, to FIGS. 21–24. Like members are denoted by like numerals and not described.

As mentioned above and as shown in the figures, this embodiment differs from the previous embodiment in that the bottom plate 1*a* is provided pivotably around a horizontal support shaft 1AX. The bottom plate 1*a* has a front edge member 1*a'* which is integral with a bottom plate 1*b* provided horizontally at the bottom of the container 11.

An inclination adjuster 60 for adjusting the inclination angle of the bottom plate 1*a* is provided so as to straddle the top plate 50*a* of the shelf 50 and the bottom plate 1*b* of the ampule container 1'. The inclination adjuster 60 comprises a hook-shaped pusher 61 and a motor 62 for pivoting the pusher 61.

The motor 62 is mounted on the back of the top plate 50*a* and has an output shaft to which is mounted a pinion 63 in mesh with a half-moon-shaped gear provided on the inner surface of the pusher 61. By pivoting the pusher 61 about a rotary shaft 61X, the bottom plate 1*a* is pushed up and inclined by a tip 61*a* of the pusher 61.

Figure 26:
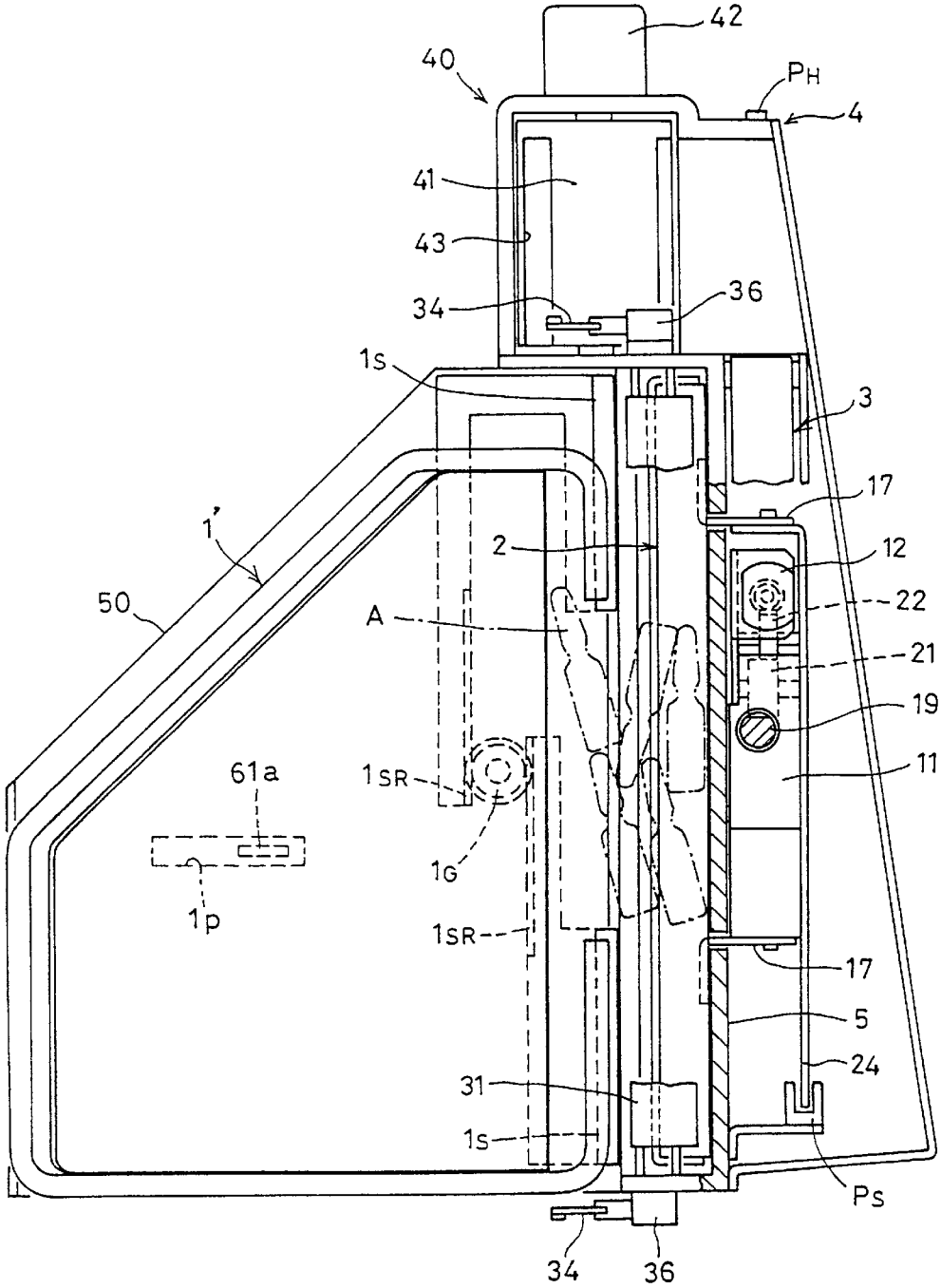
FIG. 26 is a plan view of the ampule feeder of FIG. 25.
Figure 27:
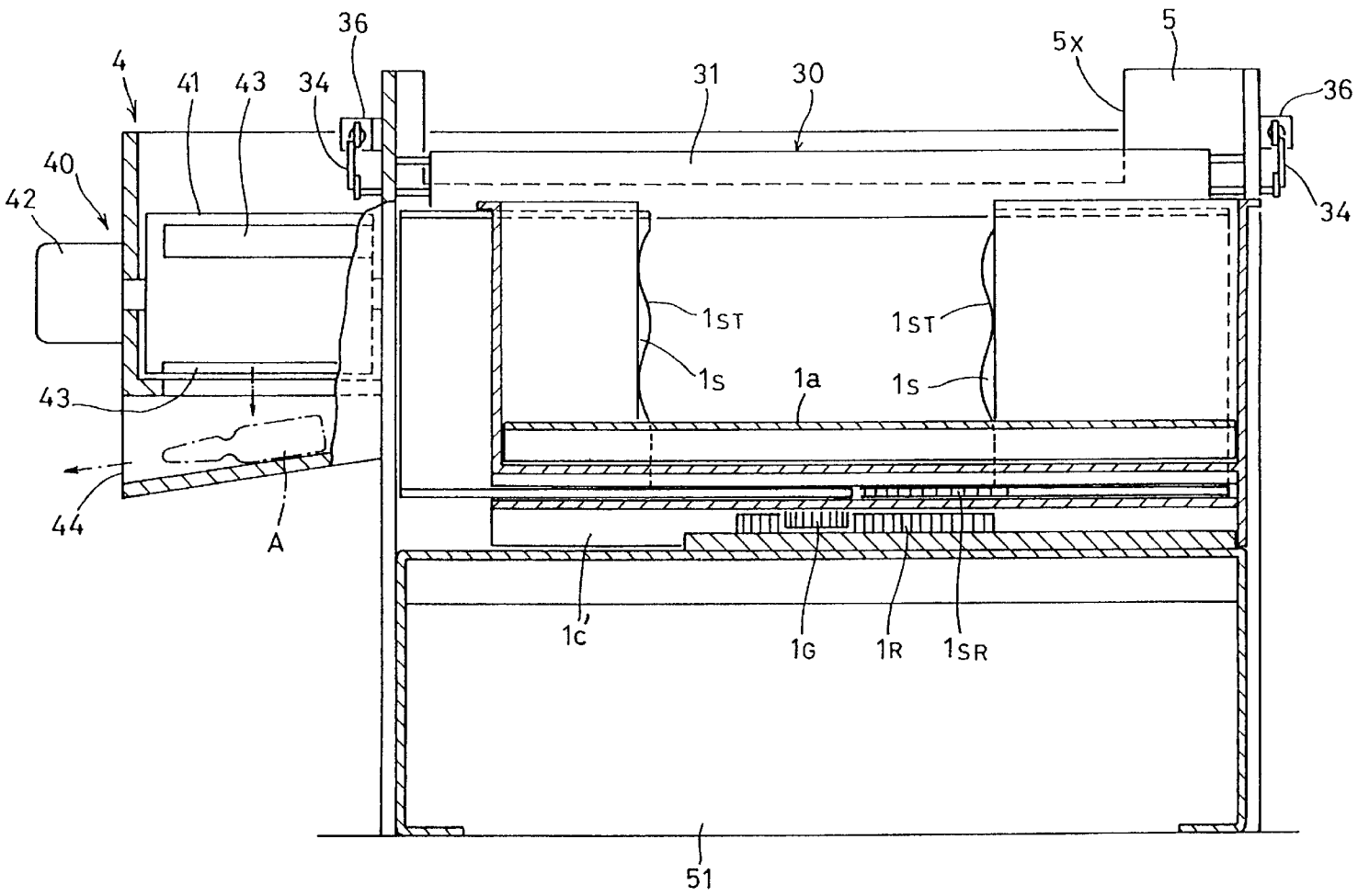
FIG. 27 is a side view as viewed in the direction of arrows XXVII—XXVII of FIG. 25.
Figure 28:
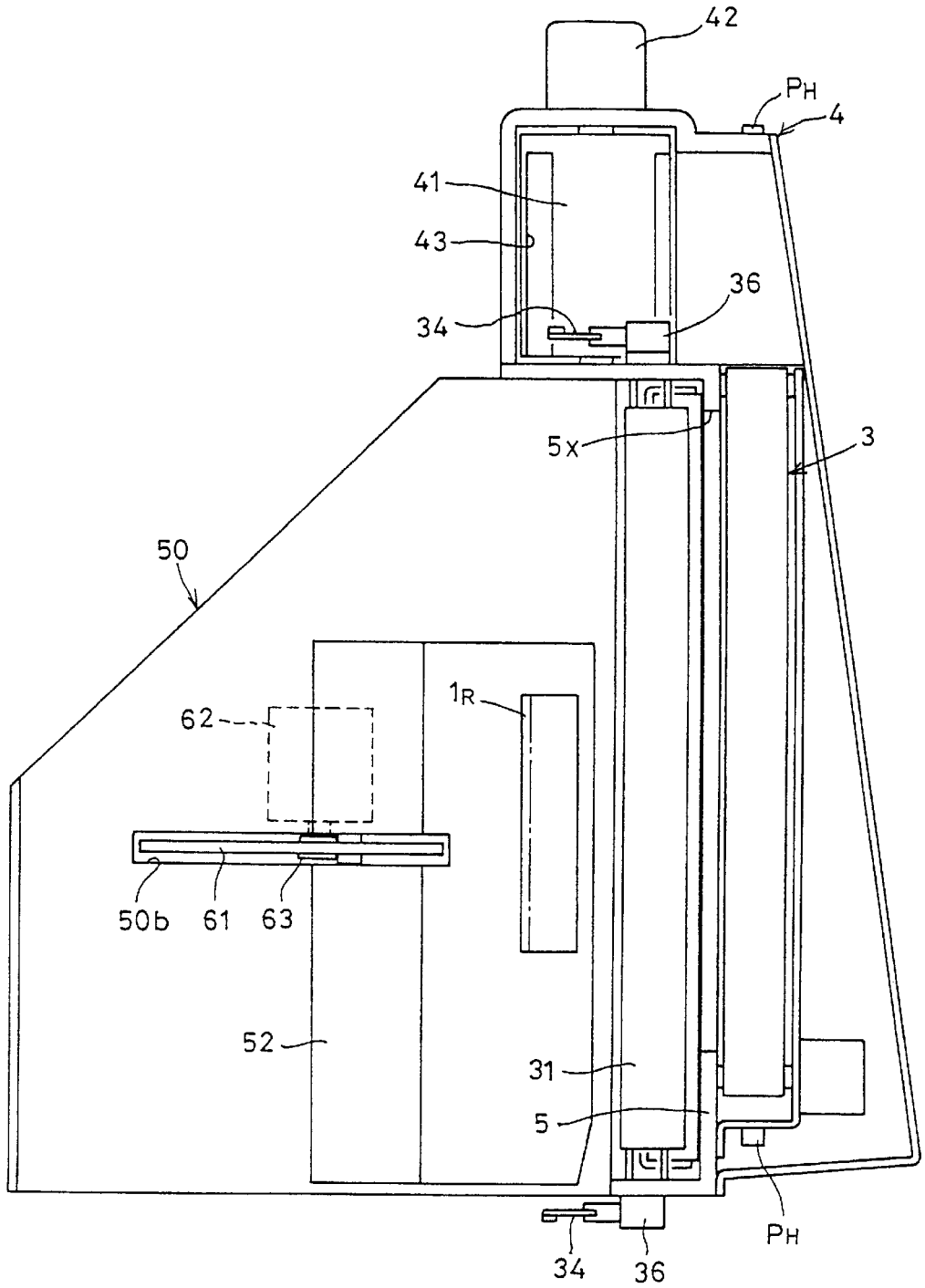
FIG. 28 is a plan view with an ampule container removed.

The top plate 50*a* and the back bottom plate 1*b* are formed with narrow slits 50*b* and 1*p* through which the tip 61*a* of the pusher 61 can swing up and down. The slits 50*b* and 1*p* are shown in FIGS. 28 and 26 respectively.

Preferably, a cover 1*af* made of a resilient material such as rubber and cloth is provided at the front end of the bottom plate 1*a* to fill a gap produced when the bottom plate 1*a* is inclined. The inclination angle of the bottom plate 1*a* may be changed continuously or stepwise.

(Eighth Embodiment)

Figure 29:
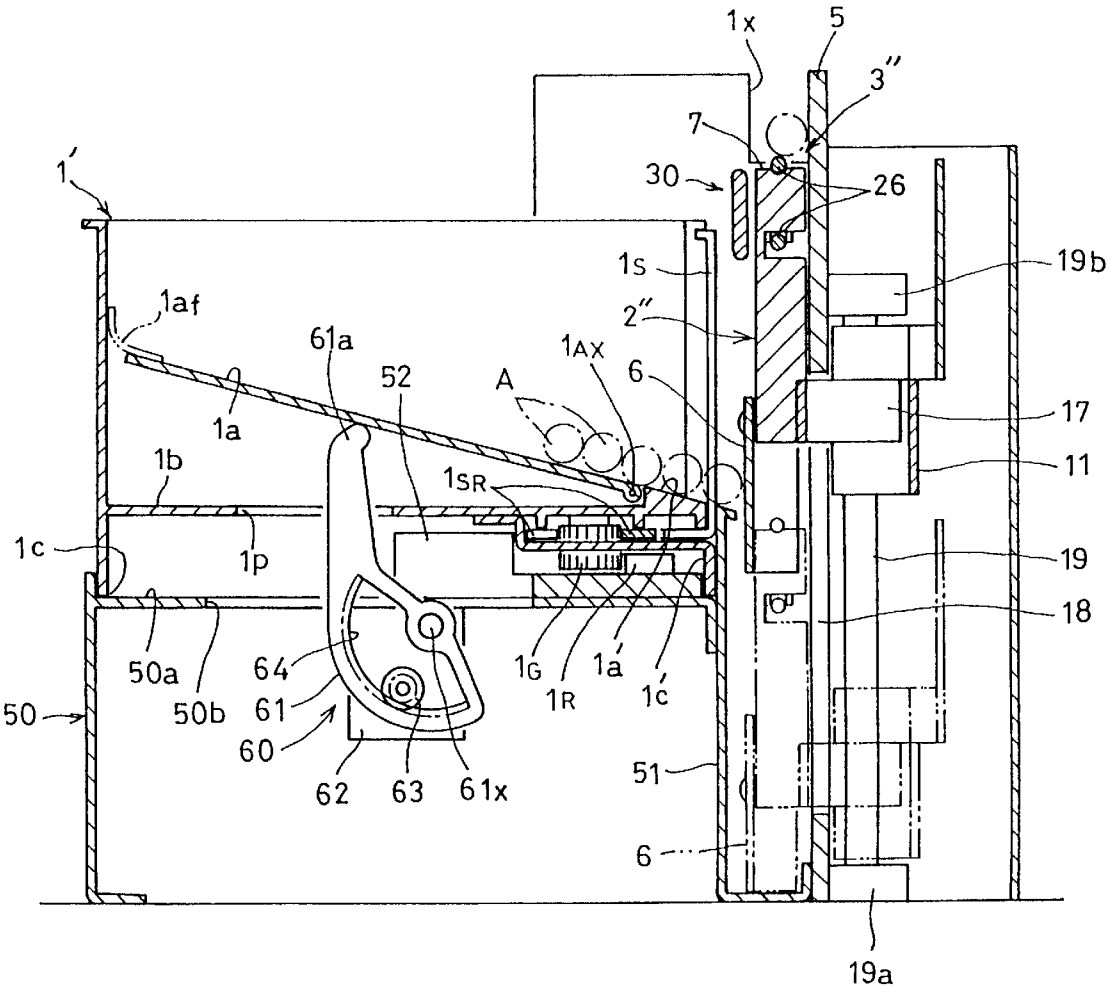
FIG. 29 is a sectional view of an ampule feeder of an eighth embodiment.
Figure 30:
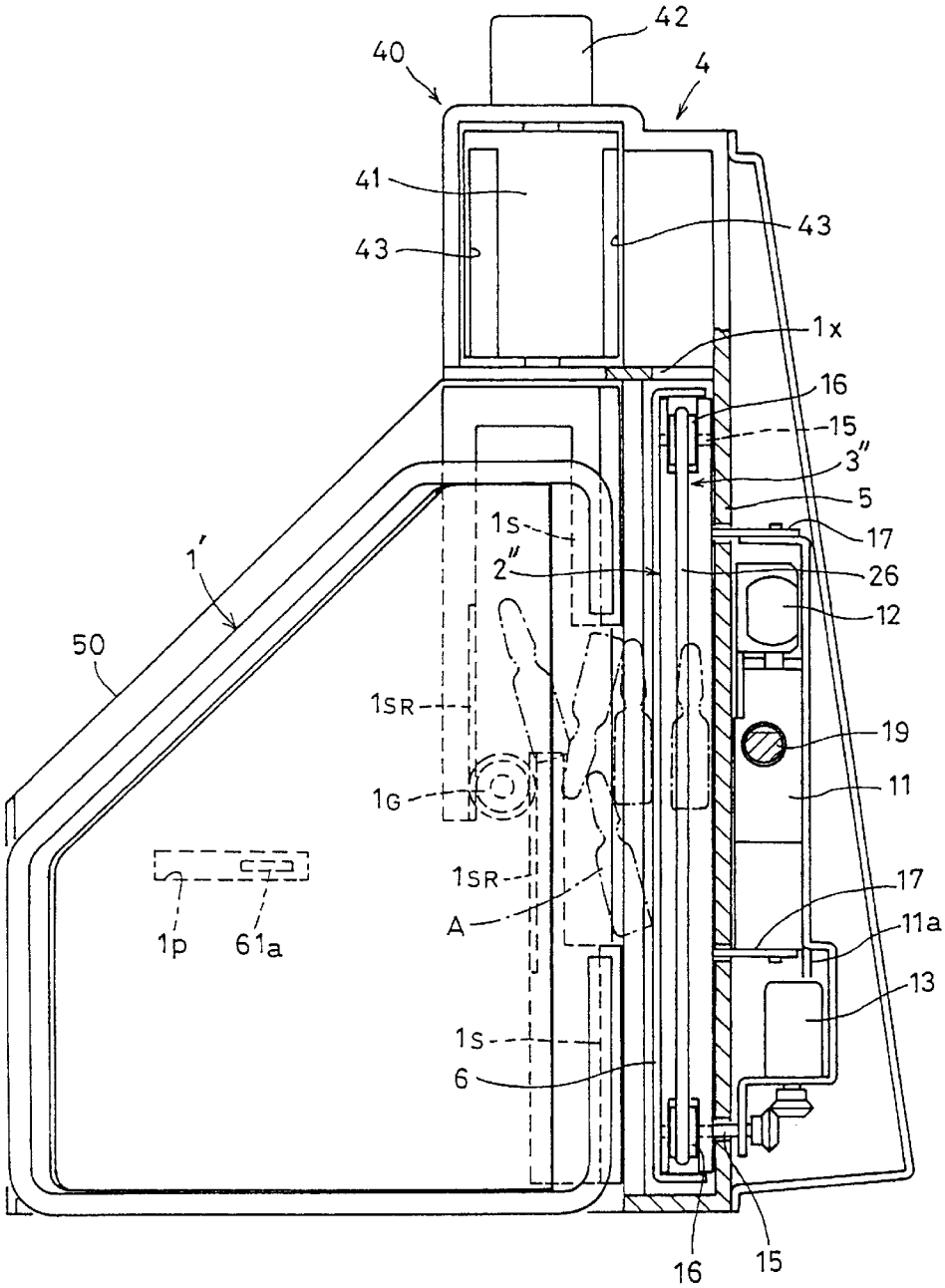
FIG. 30 is of the ampule feeder of FIG. 29.
Figure 31:
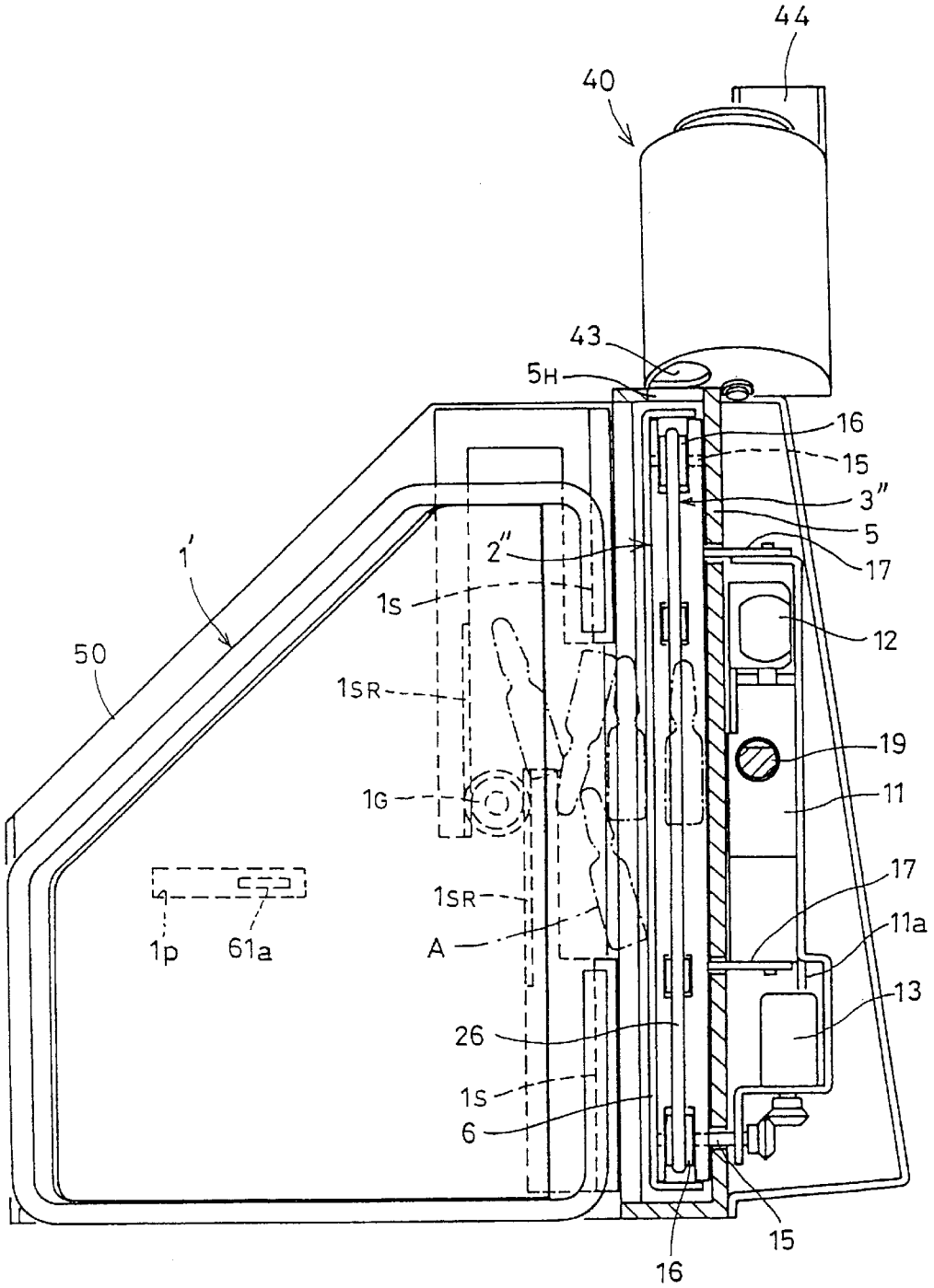
FIG. 31 is a plan view of an ampule feeder of a ninth embodiment.

FIGS. 29 and 30 show (in section and plan) an eighth embodiment, in which the detachable ampule container 1' having the inclinable bottom plate 1*a* is used in the third embodiment.

In the illustrated embodiment, as in the sixth and seventh embodiments, the ampule container 1' can be detachably set, and the bottom plate 1*a* is inclinable. Thus, no detailed description of operation is deemed necessary.

(Ninth Embodiment)

FIGS. 31–34 show a ninth embodiment, which is similar to the eighth embodiment with only the ampule catcher 4 and the discharge means 40 modified. Below, what differs from the eighth embodiment is mainly described. In this embodiment, the ampule catcher 4 is not used. The discharge means 40 is inclined a small angle (18° in the embodiment shown) so that one of the grooves 43 formed in the discharge means 40 aligns with the discharge direction of the dispenser 3" and that the inclination angle of the grooves 43 is equal to that of the outlet of the dispenser 3".

Figure 7:
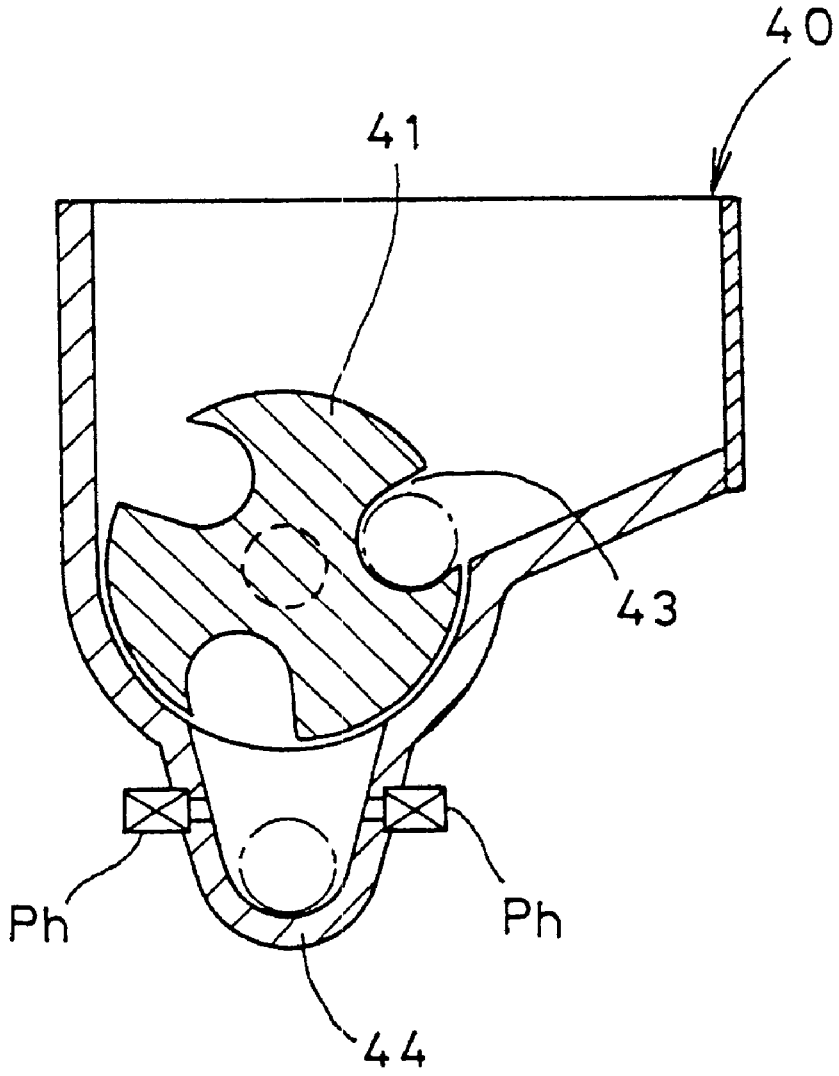
FIG. 7 is a sectional view of a discharge means.
Figure 33A:
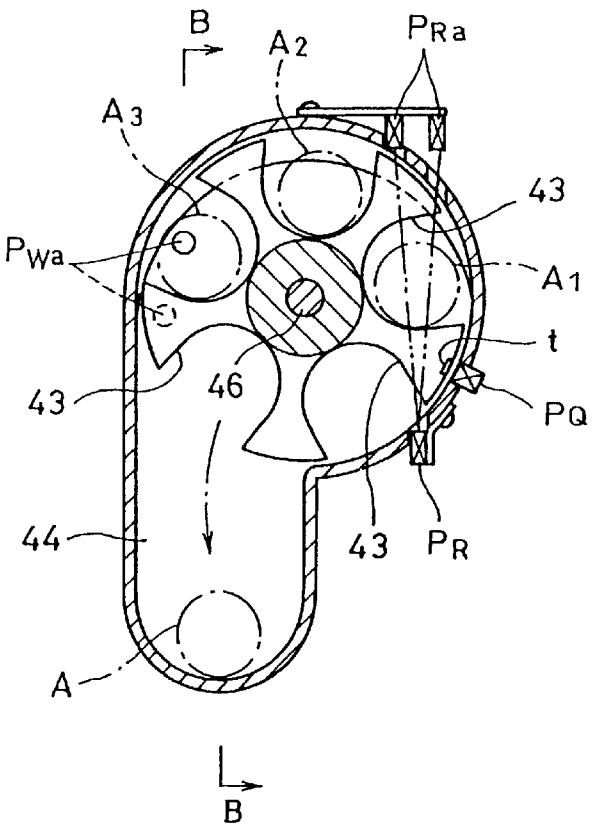
FIGS. 33A–33B are a sectional view taken along line XXXIII—XXXIII of FIG. 32.

The discharge means 40 is basically the same as shown in FIG. 7 but differs in that as shown in FIG. 33A, five grooves 43 are formed so that a greater number of ampules can be stored in the grooves 43.

Figure 32:
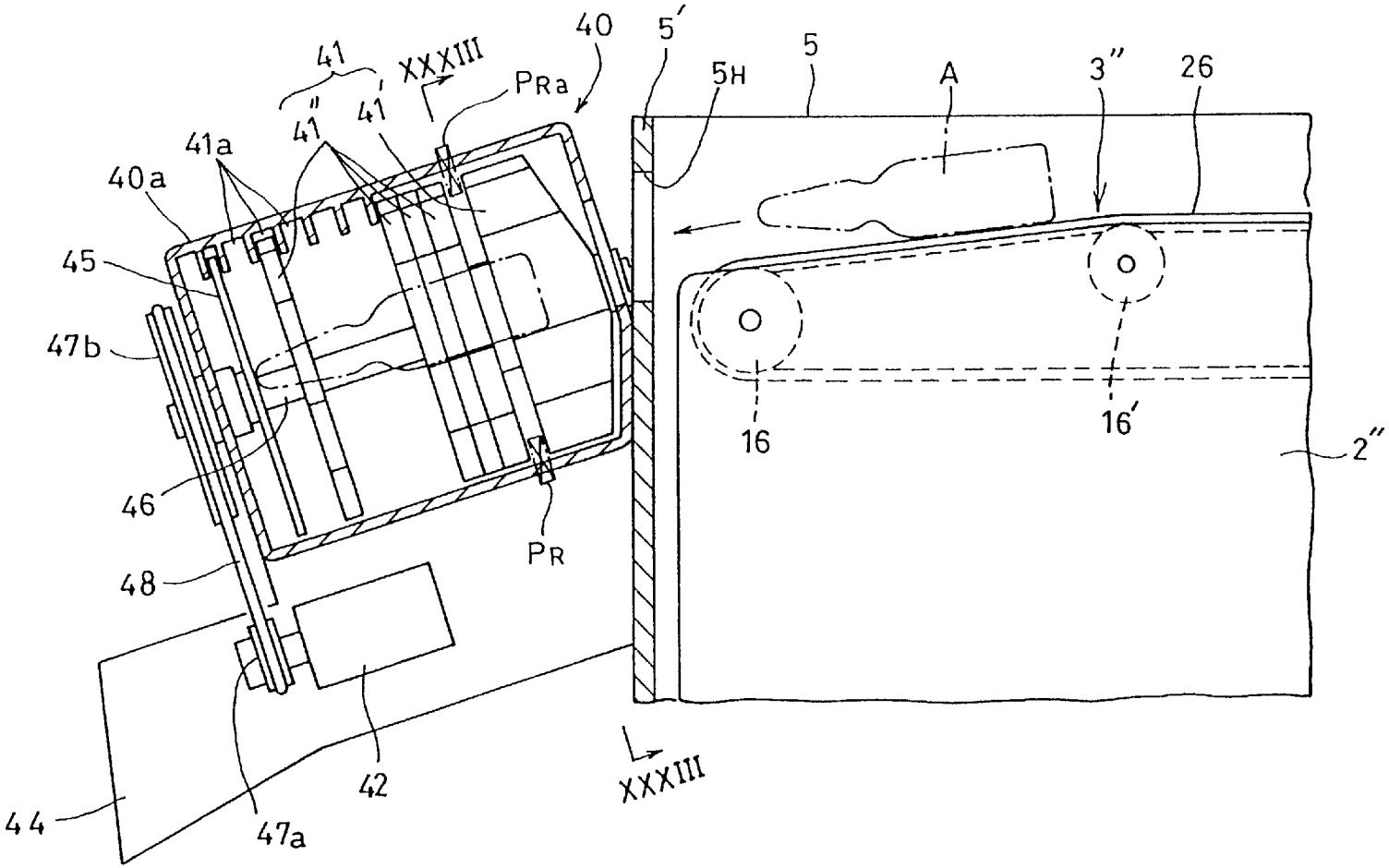
FIG. 32 is a partial section of a portion near the discharge means of the ninth embodiment.

As shown in FIG. 32, the discharge means 40 has many grooves 41*a* in the body 40*a*. Rotor disks 41" are received in some of the grooves 41*a*. These disks 41" and other disks 41' are mounted on a rotary shaft to form a rotor 41. The rotor 41 is mounted inside and rotated by transmitting the rotating force of a motor 42 to the rotary shaft through pulleys 47*a* (small) and 47*b* (large), and a belt 48.

Numeral 45 is a stopper plate to stop the ampules received in the ampule-receiving grooves 43. The rotor 41 is comprised of a plurality of separate rotor disks 41" so that the same rotor disks 41" can form the rotor 41 even if the size of the discharge means 40 is changed according to the size of ampules.

As shown in FIG. 32, an endless belt 26 of the discharge means 3" is provided at the top end of the ampule receiver 2" moved up and down along the side wall 5. The upper portion of the endless belt 26 is partially raised by a small pulley 16' so that its portion between the small pulley 16' and a pulley 16 is slightly inclined substantially the same angle as the discharge means 40. As shown, an end wall 5' protruding at a right angle from an end of the side wall 5 is formed with a hole 5H through which ampules A pass. Ampules pass through the hole 5H and are fed into the discharge means 40.

The adjacent rotor disks 41' and 41" are spaced by predetermined gaps through which light is transmitted from a light-emitting sensor PR to light-receiving sensors PRa both mounted on the body 40*a*. As shown in FIG. 33A, the light-receiving sensors PRa comprise two elements provided within a predetermined angle.

Two light-receiving elements PRa are provided so that when one of the two detects that an ampule A has been received in a groove 43, it can determine that there is an ampule. If there is only one light-receiving element PRa, it may sometimes be impossible to detect that an ampule A has been received with high reliability. PQ is a fixed sensor of the rotor 41. By sensing an element t provided on the rotor 41 at a predetermined position, it detects that the rotor has come to the predetermined position.

Figure 33B:
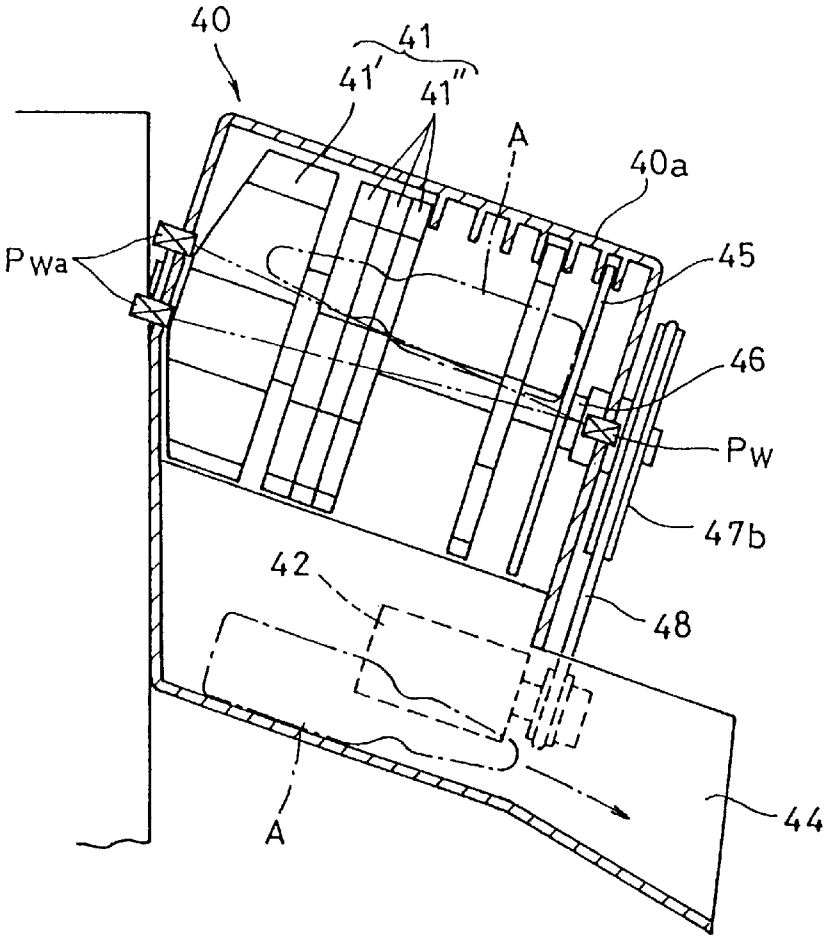

FIG. 33B shows sensors PW and PWa for determining if an ampule A is waiting at one step or position before an ampule A falling from a groove 43 by giving light in substantially the same direction as the grooves 43 extend. Like the sensors PR and PRa, the sensors PW and PWa comprise two light-receiving elements PWa and one light-emitting element for improved detection accuracy.

The ampule feeder of the ninth embodiment operates as follows to feed ampules. Description is made on the assumption that the ampule storage container 1' is initially filled with ampules A.

When the container is filled with ampules in a random manner, the bottom plate 1*a* of the ampule storage container 1' is kept in a reference state, i.e. horizontal. When the container 1' is set in the predetermined position, the shutters 1S open. When the ampule receiver 2 is lowered, some ampules move through the ampule transfer portion onto the ampule receiver 2". When the ampule receiver 2 begins to move down, the endless belt 26 of the dispenser 3 provided on the ampule receiver 2" is reversed.

Figure 34A:
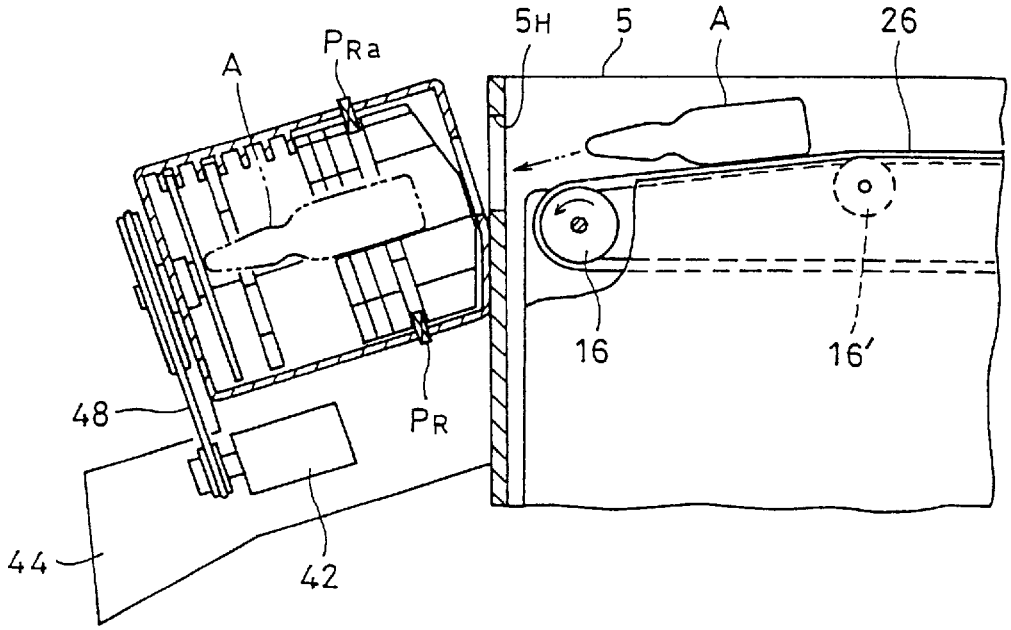
FIGS. 34A–34B explain its operation.
Figure 34B:
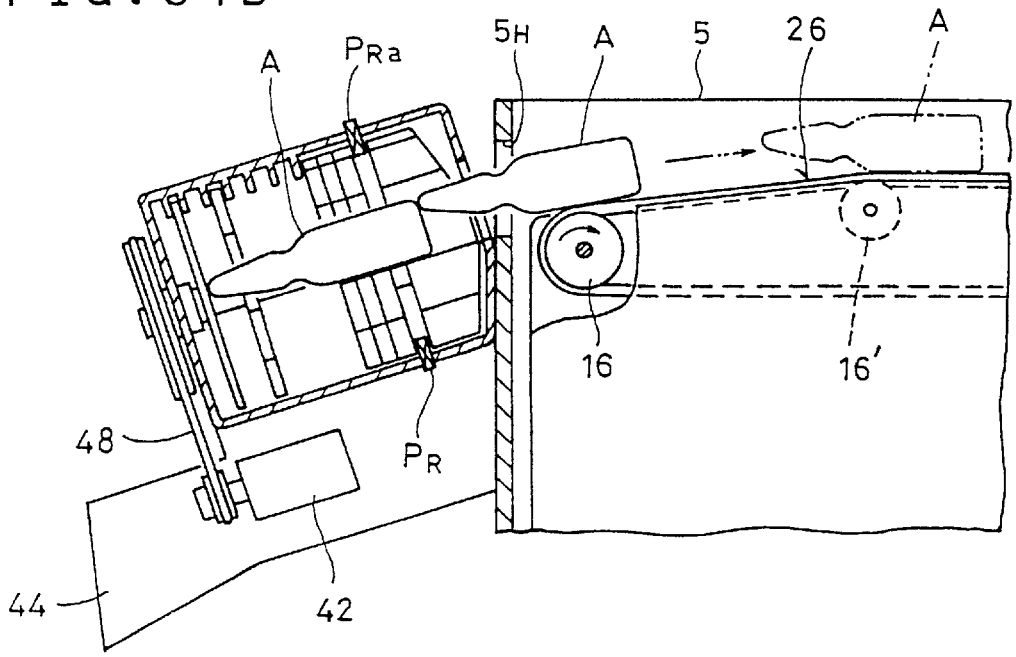

In the embodiment, by reversing the endless belt 26, any ampules piled one on another are eliminated, so that about two ampules A remain on the ampule receiver 2". As shown in FIG. 34A, the endless belt 26 of the ampule receiver 2" is raised with the two ampules thereon. In this state, the endless belt 26 is turned in the normal direction to feed the ampules A into grooves 43 of the discharge means 40. When the front one of the two ampules A is received in a groove 43, the endless belt 26 is reversed again. The rear one of the two ampules A will drop into the open position between the shutters 1S.

When ampules A are received in grooves 43, they may not be completely received in the grooves 43 (if an rotor 41 is rotated in this state, the protruding ampule may be broken.) Thus, the rotor 41 is rotated back and forth several times within a small angle by rotating the motor 42 back and forth to push the ampule completely into the groove 43 until it abuts the stopper plate 45. In this state, the sensors PR, PRa determine that ampules have been received in the grooves 43, and the rotor 41 is rotated by one pitch of a groove 43 in FIG. 33A and stopped.

The relation between the discharge means 40 and the dispenser 3 is preset such that ampules A fed from the dispenser 3 are fed to the positions of the ampules A1 shown in FIG. 33A.

When ampules A have been fed in the above manner, the same operation is repeated to feed ampules A1, A2, A3 as shown in FIG. 33A. When the sensors PW, PWa detect ampule A3, the discharge means 40 assumes a standby position. The standby position is set for the following reasons.

A plurality of ampule feeders of this embodiment are usually stacked in many tiers to form a cylinder. Different kinds of ampules are stored in the respective feeders. When a local computer receives a prescription drug data signal for each patient from a host computer (not shown), the local computer transmits a command to dispense designated ampules based on the signal received.

If ampules were raised one by one from the ampule storage container 1' of an ampule feeder designated by the ampule dispensing signal, it would be impossible to quickly dispense and collect necessary ampules upon ampule dispensing command.

As shown in FIG. 33A, ampules A1, A2, A3 are received in three empty grooves 43. While these three ampules or subsequent ampules are being pushed into grooves 43, the ampule receiver 2 may fail to catch the ampules and rise empty-handed, i.e. with no ampules received thereon.

The sensors PR, PRa detect this fact by detecting the fact that no ampule is received within a predetermined time after the ampules A have been fed by the dispenser 3 by raising the ampule receiver 2. If the ampule receiver 2 swings and misses twice, ampules are stirred by slightly inclining the bottom plate 1*a* of the ampule storage container 1' upward and then downward. Then, ampules A are raised and dispensed, and the fact that the ampules have been received is detected so that the ampule receiver will not swing and miss again.

But even with such a precaution, the ampule receiver may still swing and miss if no sufficient ampules remain in the container. In such a case, the inclination angle is increased stepwise little by little. Every time the inclination angle is increased one step to a new angle, the bottom plate is moved up and down from the new angle.

As ampules A are further dispensed from the ampule storage container 1', it will eventually become impossible to dispense ampules even by moving the bottom plate up and down. In such a case, if the ampule receiver swings and misses three times in a row, it is apparent that there is no ampule remaining in the ampule storage container 1'. Thus, the fact that ampules have run out is displayed, and the feeder is deactivated.

In this case, by pressing a container mounting/dismounting button, the bottom plate 1*a* returns to the horizontal position. By pressing the button again, the container is unlocked. The container is now detachable. The container can also be unlocked by rotating the pusher 61 of the inclination adjuster 60, shown by two-dot chain line in FIG. 25 with the motor 62 to lower the tip 61*a* below the back bottom plate 1*b*.

Thus, the ampule feeder of this embodiment can feed ampules reliably and quickly.

The ampule container can thus store ampules to its full capacity. As the number of ampules remaining in the container decreases, the bottom plate is inclined to move ampules toward the ampule receiver. Thus, ampules are always on the ampule receiver when it rises. Ampules on the ampule receiver are arranged in order while being raised and discharged one by one.

What is claimed is:

1. An ampule feeder comprising:

an ampule container having a bottom plate that is inclined in one direction toward a side of said ampule container, said ampule container being capable of randomly accommodating a plurality of ampules;

an ampule receiver that is vertically movable along a side wall provided at said lower edge of said bottom plate, said ampule receiver having a top surface for receiving a plurality of ampules thereon and arranging them in order, said top surface being substantially as wide as the diameters of the ampules accommodated in said ampule container;

a drive unit for vertically moving said ampule receiver; and an ampule transport means for discharging the ampules on said top surface of said ampule receiver in a direction in which the ampules on said top surface of said ampule receiver are arranged.

2. An ampule dispenser as claimed in claim 1, wherein said top surface of said ampule receiver is inclined in the width direction of the top surface, said ampule transport means is disposed outside of said side wall, and the ampules on said ampule receiver, can be transferred onto said ampule transport means due to the inclined top surface of said ampule receiver in a raised position of said ampule receiver.

3. An ampule dispenser as claimed in claim 1, wherein said top surface of said ampule receiver is horizontal in a longitudinal direction of said top surface of said ampule receiver, and said top surface has a cross-sectional shape capable of retaining the ampules on said top surface of said ampule receiver.

4. An ampule dispenser as claimed in claim 3, wherein said ampule transport means comprises:

a device for pushing ampules, retained on said top surface of said ampule receiver, outwardly of said side wall; and a conveyor for receiving the ampules pushed from said ampule receiver and feeding the ampules in a discharge direction.

5. An ampule dispenser as claimed in claim 1, wherein said ampule transport means is mounted on said ampule receiver.

6. An ampule dispenser as claimed in claim 1, further comprising means for dropping any ampule from said ampule receiver if the ampule is supported on said top surface in an upright position.

7. An ampule dispenser as claimed in claim 1, further comprising means for detecting the presence of ampules on said ampule receiver or said ampule transport means.

8. An ampule dispenser as claimed in claim 1, further comprising a shelf disposed adjacent to said ampule receiver, wherein said ampule container is detachably mounted on said shelf and includes a shutter for closing an ampule transfer portion through which ampules can be transferred from said ampule container to said ampule receiver when said ampule container is mounted on said shelf.

9. An ampule dispenser as claimed in claim 8, further comprising means for opening and closing said shutter.

10. An ampule dispenser as claimed in claim 9, wherein said shutter comprises a pair of shutter members each having corrugated opposed edges, wherein said corrugated opposed edges abut each other in a closed position of said shutter.

11. An ampule dispenser as claimed in claim 9, wherein said ampule container is slidable in a longitudinal direction of said ampule receiver, and said shutter is slidable in at least one direction relative to said ampule transfer portion, and wherein said means for opening and closing said shutter comprises:

a rack provided along the slide direction of said ampule container and formed at one corner of said shutter;

a gear adapted to mesh with said rack such that, when said ampule container is moved in the slide direction from said shelf with said gear in mesh with said rack, said shutter is moved to a closed position thereby preventing any ampules in said ampule container from spilling out of said ampule container.

12. An ampule dispenser as claimed in claim 1, wherein said bottom plate is pivotable about its lower edge, and said ampule dispenser further comprises an inclination adjuster for adjusting the inclination angle of said bottom plate.

13. An ampule dispenser as claimed in claim 12, further comprising a discharge means, connected to said ampule transport means, for storing a predetermined number of ampules dispensed from said ampule transport means and discharging a required number of ampules in response to a discharge signal, said discharge means comprising a rotor having a plurality of grooves for receiving the ampules, and a drive means for rotating said rotor, said rotor being positioned such that one of said grooves at an ampule-receiving position is oriented in the direction in which the ampules are dispensed from said ampule transport means.

14. An ampule dispenser comprising:

an ampule container having a bottom plate that is inclined in one direction toward a side of said ampule container, said ampule container being capable of randomly accommodating a plurality of ampules;

an ampule receiver that is vertically movable along a side wall positioned adjacent said lower edge of said bottom plate, said ampule receiver including a lower member and an upper member pivotally mounted on said lower member, wherein said upper member has a top surface for receiving a plurality of ampules thereon and arranging them in order, wherein said top surface is substantially as wide as the diameters of the ampules accommodated in said ampule container, and wherein said top surface has a cross-sectional shape capable of retaining the ampules thereon;

a drive unit for vertically moving said ampule receiver; and means for inclining said upper member from a horizontal position in order to drop the ampules on said top surface when said upper member is raised by said drive unit to a point above a predetermined level, wherein said means for inclining said upper member utilizes a rising driving force of said upper member.

15. An ampule dispenser as claimed in claim 14, further comprising means for dropping any ampule, supported in an upright position on said ampule receiver, from said ampule receiver.

16. An ampule dispenser as claimed in claim 14, further comprising means for detecting the presence of ampules on said ampule receiver.

17. An ampule dispenser as claimed in claim 14, further comprising a shelf disposed adjacent to said ampule receiver, wherein said ampule container is detachably mounted on said shelf and includes a shutter for closing an ampule transfer portion through which ampules can be transferred from said ampule container to said ampule receiver when said ampule container is mounted on said shelf.

18. An ampule dispenser as claimed in claim 17, further comprising means for opening and closing said shutter.

19. An ampule dispenser as claimed in claim 17, wherein said shutter comprises a pair of shutter members each having corrugated opposed edges, wherein said corrugated opposed edges abut each other in a closed position of said shutter.

20. An ampule dispenser as claimed in claim 18, wherein said ampule container is slidable is a longitudinal direction of said ampule receiver, and said shutter is slidable in at least one direction relative to said ampule transfer portion, and wherein said means for opening and closing said shutter comprises:

a rack provided along the slide direction of said ampule container and formed at one corner of said shutter;

a gear adapted to mesh with said rack such that, when said ampule container is moved in the slide direction from said shelf with said gear in mesh with said rack, said shutter closes and thereby prevents any ampules in said ampule container from spilling out of said ampule container.

21. An ampule dispenser as claimed in claim 14, wherein said bottom plate can be pivoted about said lower edge, and said ampule dispenser further comprising an inclination adjuster for adjusting the inclination angle of said bottom plate.

22. An ampule dispenser as claimed in claim 21, further comprising a discharge means, disposed adjacent an end of said upper member of said ampule receiver, for storing a predetermined number of ampules dispensed from said upper member and discharging a required number of ampules in response to a discharge signal, said discharge means comprising a rotor having a plurality of grooves for receiving the ampules, and a drive means for rotating said rotor, said rotor being positioned such that one of said grooves at an ampule-receiving position is oriented in the direction in which the ampules are dispensed from said upper member.

23. An ampule feeder comprising:

an ampule container having a bottom plate that is inclined toward one side of said ampule container, said ampule container being capable of randomly accommodating a plurality of ampules;

an ampule receiver disposed adjacent the one side of said ampule container, said ampule receiver being vertically movable between a lower position and an upper position along an upstanding wall, wherein at the lower position, ampules can be received in a linear arrangement in which the ampules are longitudinally aligned on a top surface of said ampule receiver;

a drive unit for vertically moving said ampule receiver between the lower position and the upper position; and an ampule transport device for moving ampules away from the upper position of said ampule receiver in the longitudinally aligned linear arrangement.

24. An ampule dispenser as claimed in claim 23, further comprising an ampule dispenser located in the vicinity of said ampule transport device such that the ampules transported by said ampule transport device are received by said ampule dispenser.

25. An ampule feeder as claimed in claim 23, wherein said drive unit comprises a support plate connected to said ampule receiver, a vertical rod extending through said support plate and having a rack formed thereon, and a motor operatively connected to said rack via a speed reducer such that said support plate can be moved up and down by operation of said motor.

26. An ampule feeder as claimed in claim 23, wherein said ampule transport device comprises an endless belt conveyor extending in parallel to said ampule receiver, said endless belt conveyor being disposed on an opposite side of said upstanding wall relative to said ampule receiver, wherein said top surface of said ampule receiver is an angled surface toward said upstanding wall so that, at the upper position of said ampule receiver, the ampules that have been raised by said ampule receiver will move onto the endless conveyor to be transported in the longitudinally aligned linear arrangement.

27. An ampule feeder as claimed in claim 23, further comprising an ampule kicker for moving ampules from the top surface of said ampule receiver in a direction toward said ampule transport device, wherein said top surface is formed as a concave surface for retaining the ampules thereon.

28. An ampule feeder as claimed in claim 27, wherein said ampule transport device comprises an endless belt conveyor extending in parallel to said ampule receiver, said endless belt conveyor being disposed on an opposite side of said upstanding wall relative to said ampule receiver.

29. An ampule feeder as claimed in claim 23, wherein said ampule transport device comprises an endless conveyor mounted on said ampule receiver, wherein said endless conveyor is operative to transport the longitudinally aligned ampules from the top surface of said ampule receiver when said ampule receiver is in the upper position.

30. An ampule feeder as claimed in claim 23, wherein said ampule receiver includes a shutter for limiting movement of ampules in said ampule container when said ampule receiver is in a raised position.

* * * * *